US009339926B2

(12) United States Patent
Kibblewhite

(10) Patent No.: US 9,339,926 B2
(45) Date of Patent: May 17, 2016

(54) SYSTEM FOR PERFORMING PREDEFINED FASTENER INSTALLATION PROCEDURES

(75) Inventor: Ian E. Kibblewhite, Wayne, PA (US)

(73) Assignee: Innovation Plus, LLC, King of Prussia, PA (US)

( * ) Notice: Subject to any disclaimer, the term of this patent is extended or adjusted under 35 U.S.C. 154(b) by 264 days.

(21) Appl. No.: 13/261,504

(22) PCT Filed: May 2, 2011

(86) PCT No.: PCT/US2011/000759

§ 371 (c)(1),
(2), (4) Date: Nov. 5, 2012

(87) PCT Pub. No.: WO2011/139350

PCT Pub. Date: Nov. 10, 2011

(65) Prior Publication Data

US 2013/0047408 A1 Feb. 28, 2013

Related U.S. Application Data

(60) Provisional application No. 61/343,723, filed on May 3, 2010, provisional application No. 61/400,815, filed on Aug. 3, 2010.

(51) Int. Cl.
*B25F 5/00* (2006.01)
*B25B 21/00* (2006.01)
(Continued)

(52) U.S. Cl.
CPC ..... *B25F 5/00* (2013.01); *B25B 21/002* (2013.01); *B25B 21/02* (2013.01);
(Continued)

(58) Field of Classification Search
CPC ... B21D 39/034; B21D 39/037; B21D 39/025
USPC ..... 29/243.5–243.58
See application file for complete search history.

(56) References Cited

U.S. PATENT DOCUMENTS 1,909,476 A 5/1933 Trotter
2,413,797 A 1/1947 Stone
(Continued)

FOREIGN PATENT DOCUMENTS

DE 33 27 964 2/1985
DE 199 17 222 11/2000
(Continued)

OTHER PUBLICATIONS

A & W Devices, Brentwood, CA, Web Site pp. 5, Sep. 4, 2006.
Bibel, G.D., "Tightening Groups of Fasteners in a Structure and the Resulting Elastic Interaction", Handbook of Bolts and Bolted Joints, Chapter 24, pp. 451 to 477, Marcel Dekker Inc. (1998).
Load Control Technologies, King of Prussia, PA, Pages from Product Catalog (2), May 14, 2007.
(Continued)

*Primary Examiner* — Lee D Wilson
(74) *Attorney, Agent, or Firm* — Panitch Schwarze Belisario & Nadel LLP

(57) ABSTRACT

Complex assembly procedures for joining components with plural fasteners are accomplished using predefined procedures for performing a multi-step assembly of a joint using a dynamically controllable assembly tool, or to inspect an assembled joint. An assembly tool is coupled with an electronically controlled regulator for reducing the tightening rate, or the load increase per impact for an impact or impulse tool, so the tool can be stopped precisely at a specified stopping load or torque. The predefined procedures for performing the desired tightening operation are established in a controller coupled with the electronically controlled regulator, for dynamically controlling the assembly tool. The system can be used to assemble joints involving multiple fasteners and which are subject to elastic interaction between the fasteners, rocking, or joint relaxation, and in assembly or inspection operations in which an operator is to be guided through a particular sequence of instructions.

30 Claims, 19 Drawing Sheets

(51) Int. Cl.

| | |
|---|---|
| ***B25B 21/02*** | (2006.01) |
| ***B25B 23/00*** | (2006.01) |
| ***B25B 23/14*** | (2006.01) |
| ***B25B 23/142*** | (2006.01) |
| ***B25B 23/145*** | (2006.01) |

(52) U.S. Cl.

CPC ..... *B25B 23/0085* (2013.01); *B25B 23/14* (2013.01); *B25B 23/1425* (2013.01); *B25B 23/1453* (2013.01); *Y10T 29/49947* (2015.01); *Y10T 29/53* (2015.01)

(56) References Cited

U.S. PATENT DOCUMENTS

| | | | | |
|---|---|---|---|---|
| 3,181,672 | A | | 5/1965 | Swanson |
| 3,774,479 | A | | 11/1973 | Lesner |
| 3,969,810 | A | * | 7/1976 | Pagano ..... 29/407.02 |
| 3,969,960 | A | | 7/1976 | Pagano |
| 4,006,784 | A | | 2/1977 | Dudek |
| 4,008,772 | A | | 2/1977 | Boys |
| 4,043,222 | A | | 8/1977 | Dudek |
| 4,074,772 | A | | 2/1978 | Jonsson |
| 4,104,778 | A | | 8/1978 | Vliet |
| 4,281,538 | A | | 8/1981 | Dudek |
| 4,281,987 | A | | 8/1981 | Kleesattel |
| 4,294,122 | A | | 10/1981 | Couchman |
| 4,295,377 | A | | 10/1981 | Couchman |
| 4,305,471 | A | | 12/1981 | Eshghy |
| 4,316,512 | A | | 2/1982 | Kibblewhite et al. |
| 4,333,351 | A | | 6/1982 | Bickford |
| 4,344,138 | A | | 8/1982 | Frasier |
| 4,471,657 | A | | 9/1984 | Voris et al. |
| 4,569,229 | A | | 2/1986 | de Halleux |
| 4,602,511 | A | | 7/1986 | Holt |
| 4,649,753 | A | | 3/1987 | Goodsmith |
| 4,846,001 | A | | 7/1989 | Kibblewhite |
| 4,899,591 | A | | 2/1990 | Kibblewhite |
| 4,977,898 | A | | 12/1990 | Schwarzschild et al. |
| 5,018,988 | A | * | 5/1991 | Kibblewhite et al. ..... 439/577 |
| 5,029,480 | A | | 7/1991 | Kibblewhite |
| 5,042,015 | A | | 8/1991 | Stringer |
| 5,092,175 | A | | 3/1992 | Winckler et al. |
| 5,131,276 | A | | 7/1992 | Kibblewhite |
| 5,150,714 | A | | 9/1992 | Green |
| 5,165,831 | A | | 11/1992 | Yager et al. |
| 5,170,277 | A | | 12/1992 | Bard et al. |
| 5,211,061 | A | | 5/1993 | Goodwin |
| 5,216,622 | A | | 6/1993 | Kibblewhite et al. |
| 5,220,839 | A | | 6/1993 | Kibblewhite |
| 5,242,253 | A | | 9/1993 | Fulmer |
| 5,278,775 | A | | 1/1994 | Bibel |
| 5,291,789 | A | | 3/1994 | Walton |
| 5,303,585 | A | | 4/1994 | Lichte |
| 5,343,785 | A | | 9/1994 | Holt et al. |
| 5,366,026 | A | * | 11/1994 | Maruyama et al. ..... 173/180 |
| 5,437,525 | A | | 8/1995 | Bras |
| 5,439,063 | A | * | 8/1995 | Anders et al. ..... 173/177 |
| 5,717,143 | A | | 2/1998 | Jenco |
| 5,726,349 | A | | 3/1998 | Palmertree et al. |
| 5,807,048 | A | | 9/1998 | d'Agraives et al. |
| 5,970,798 | A | | 10/1999 | Gleman et al. |
| 6,009,380 | A | | 12/1999 | Vecchio et al. |
| 6,009,759 | A | | 1/2000 | Kibblewhite |
| 6,053,906 | A | | 4/2000 | Honda et al. |
| 6,078,874 | A | | 6/2000 | Piety et al. |
| 6,103,072 | A | | 8/2000 | Nishiwaki et al. |
| 6,142,023 | A | | 11/2000 | Cole et al. |
| 6,167,758 | B1 | | 1/2001 | Fomitchev |
| 6,186,010 | B1 | | 2/2001 | Eguchi et al. |
| 6,239,737 | B1 | | 5/2001 | Black |
| 6,268,796 | B1 | | 7/2001 | Gnadinger et al. |
| 6,338,716 | B1 | | 1/2002 | Hossack et al. |
| 6,340,868 | B1 | | 1/2002 | Lys et al. |
| 6,341,271 | B1 | | 1/2002 | Salvo et al. |
| 6,350,245 | B1 | | 2/2002 | Cimino |
| 6,502,463 | B1 | | 1/2003 | Clark et al. |
| 6,598,900 | B2 | | 7/2003 | Stanley et al. |
| 6,633,821 | B2 | | 10/2003 | Jackson et al. |
| 6,671,185 | B2 | | 12/2003 | Duval |
| 6,712,570 | B2 | | 3/2004 | Kersten |
| 6,726,960 | B1 | | 4/2004 | Sanduja et al. |
| 6,843,628 | B1 | | 1/2005 | Hoffmeister et al. |
| 6,907,944 | B2 | | 6/2005 | Sale et al. |
| 6,990,866 | B2 | | 1/2006 | Kibblewhite |
| 7,441,462 | B2 | | 10/2008 | Kibblewhite |
| 7,467,556 | B2 | | 12/2008 | Kibblewhite et al. |
| 7,614,303 | B2 | | 11/2009 | McInerney et al. |
| 7,644,627 | B2 | | 1/2010 | Kibblewhite et al. |
| 7,650,792 | B2 | | 1/2010 | Kibblewhite |
| 7,823,458 | B2 | | 11/2010 | Kibblewhite et al. |
| 7,946,179 | B2 | | 5/2011 | Kibblewhite et al. |
| 8,028,585 | B2 | | 10/2011 | Kibblewhite |
| 8,033,181 | B2 | * | 10/2011 | Kibblewhite et al. ..... 73/761 |
| 8,037,772 | B2 | | 10/2011 | Kibblewhite et al. |
| 2001/0014262 | A1 | | 8/2001 | Friederich et al. |
| 2002/0044063 | A1 | | 4/2002 | Blagin et al. |
| 2003/0095847 | A1 | | 5/2003 | Cheal |
| 2003/0173098 | A1 | | 9/2003 | Miner et al. |
| 2004/0045729 | A1 | | 3/2004 | Lehnert et al. |
| 2004/0050567 | A1 | | 3/2004 | Tambini |
| 2004/0065154 | A1 | | 4/2004 | Kibblewhite |
| 2005/0161241 | A1 | | 7/2005 | Frauhammer et al. |
| 2006/0004290 | A1 | | 1/2006 | Smith et al. |
| 2006/0102367 | A1 | | 5/2006 | Etter et al. |
| 2006/0123917 | A1 | | 6/2006 | Kibblewhite |
| 2006/0157262 | A1 | | 7/2006 | Chen |
| 2007/0151740 | A1 | * | 7/2007 | Friberg et al. ..... 173/1 |
| 2009/0038402 | A1 | | 2/2009 | Kibblewhite et al. |
| 2009/0055028 | A1 | * | 2/2009 | Kibblewhite et al. ..... 700/275 |
| 2009/0188536 | A1 | | 7/2009 | Ho |
| 2013/0047408 | A1 | * | 2/2013 | Kibblewhite ..... 29/525.01 |

FOREIGN PATENT DOCUMENTS

| | | | |
|---|---|---|---|
| EP | 0 441 145 | | 8/1991 |
| EP | 0 535 919 | | 4/1993 |
| EP | 0 541 476 | | 5/1993 |
| EP | 1 549 862 | | 1/2008 |
| EP | 1 364 132 | | 4/2012 |
| EP | 2566661 | | 3/2013 |
| JP | 04-166732 | A | 6/1992 |
| JP | 10-086074 | | 4/1998 |
| JP | 02-002239939 | A | 8/2002 |
| KR | 10-2008-094930 | | 10/2008 |
| WO | WO 00/63565 | | 10/2000 |
| WO | WO 02/061292 | | 8/2002 |
| WO | WO 2004/027271 | | 4/2004 |
| WO | WO 2005/063448 | | 7/2005 |
| WO | WO 2007/089759 | | 8/2007 |
| WO | WO 2007/089760 | | 8/2007 |
| WO | WO 2007/117575 | | 10/2007 |
| WO | WO 2007/139834 | | 12/2007 |
| WO | WO 2011/139350 | | 11/2011 |

OTHER PUBLICATIONS

TorcUP Inc., Easton, PA, Web Site p. 1, Nov. 10, 2006.

R. Adams, "Bar Code 1, 2-Dimensional Bar Code Page", Adams Communications, Apr. 12, 1999 (http://web.archive.org/web/20000229163608/http://www.adams1.com/pub/russadam/stack.html).

"Insuring Your Products' Future Through Chemical Grafting", Polymer Research Corporation of America, Brooklyn, NY.

"TAPTITE 2000® Thread Rolling Fasteners" Catalog, REMINC Research Engineering & Manufacturing Inc., Middletown, Rhode Island (2001).

* cited by examiner

*Fig. 8A*

```
0:Metric
1:ScanBolt,1,Part=LCT Flange Demo
2:ScanBolt,2,Part=LCT Flange Demo
3:ScanBolt,3,Part=LCT Flange Demo
4:ScanBolt,4,Part=LCT Flange Demo
5:ScanBolt,5,Part=LCT Flange Demo
6:ScanBolt,6,Part=LCT Flange Demo
7:ScanBolt,7,Part=LCT Flange Demo
8:ScanBolt,8,Part=LCT Flange Demo,BoltCheck=8,IfLO=P Connect Multiplexer - Switch?,IfHI=P Connect Multiplexer
- Switch?,IfOK=P Connect Multiplexer - Switch?,IfFault=P Connect Multiplexer - Switch?
9:InspectBolt,1,Mode=2,AP=1,Load=108,MinLoad=100,MaxLoad=120,IfFault=P Call Supervisor
10:InspectBolt,2,Mode=2,AP=1,Load=108,MinLoad=100,MaxLoad=120,IfFault=P Call Supervisor
11:InspectBolt,3,Mode=2,AP=1,Load=108,MinLoad=100,MaxLoad=120,IfFault=P Call Supervisor
12:InspectBolt,4,Mode=2,AP=1,Load=108,MinLoad=100,MaxLoad=120,IfFault=P Call Supervisor
13:InspectBolt,5,Mode=2,AP=1,Load=108,MinLoad=100,MaxLoad=120,IfFault=P Call Supervisor
14:InspectBolt,6,Mode=2,AP=1,Load=108,MinLoad=100,MaxLoad=120,IfFault=P Call Supervisor
15:InspectBolt,7,Mode=2,AP=1,Load=108,MinLoad=100,MaxLoad=120,IfFault=P Call Supervisor
16:InspectBolt,8,Mode=2,AP=1,Load=108,MinLoad=100,MaxLoad=120,IfFault=P Call Supervisor
17:InspectBolt,1,Mode=2,AP=1,Load=27,MinLoad=24,MaxLoad=50,IfOK=19,IfHI=19,IfFault=P Call Supervisor
18:TightenBolt,1,Mode=18,AP=1,Load=27,MinLoad=24,MaxLoad=50,MaxTorque=95,IfFault=P Call Supervisor
19:InspectBolt,5,Mode=2,AP=1,Load=27,MinLoad=24,MaxLoad=50,IfOK=21,IfHI=21,IfFault=P Call Supervisor
20:TightenBolt,5,Mode=18,AP=1,Load=27,MinLoad=24,MaxLoad=35,MaxTorque=95,IfFault=P Call Supervisor
21:InspectBolt,7,Mode=2,AP=1,Load=27,MinLoad=24,MaxLoad=50,IfOK=23,IfHI=23,IfFault=P Call Supervisor
22:TightenBolt,7,Mode=18,AP=1,Load=27,MinLoad=24,MaxLoad=35,MaxTorque=95,IfFault=P Call Supervisor
23:InspectBolt,3,Mode=2,AP=1,Load=27,MinLoad=24,MaxLoad=50,IfOK=25,IfHI=25,IfFault=P Call Supervisor
24:TightenBolt,3,Mode=18,AP=1,Load=27,MinLoad=24,MaxLoad=35,MaxTorque=95,IfFault=P Call Supervisor
25:InspectBolt,8,Mode=2,AP=1,Load=27,MinLoad=24,MaxLoad=50,IfOK=27,IfHI=27,IfFault=P Call Supervisor
26:TightenBolt,8,Mode=18,AP=1,Load=27,MinLoad=24,MaxLoad=35,MaxTorque=95,IfFault=P Call Supervisor
27:InspectBolt,4,Mode=2,AP=1,Load=27,MinLoad=24,MaxLoad=50,IfOK=29,IfHI=29,IfFault=P Call Supervisor
28:TightenBolt,4,Mode=18,AP=1,Load=27,MinLoad=24,MaxLoad=35,MaxTorque=95,IfFault=P Call Supervisor
29:InspectBolt,6,Mode=2,AP=1,Load=27,MinLoad=24,MaxLoad=50,IfOK=31,IfHI=31,IfFault=P Call Supervisor
30:TightenBolt,6,Mode=18,AP=1,Load=27,MinLoad=24,MaxLoad=35,MaxTorque=95,IfFault=P Call Supervisor
31:InspectBolt,2,Mode=2,AP=1,Load=27,MinLoad=24,MaxLoad=50,IfOK=33,IfHI=33,IfFault=P Call Supervisor
32:TightenBolt,2,Mode=18,AP=1,Load=27,MinLoad=24,MaxLoad=35,MaxTorque=95,IfFault=P Call Supervisor
33:InspectBolt,1,Mode=2,AP=1,Load=108,MinLoad=100,MaxLoad=120,IfFault=P Call Supervisor
34:InspectBolt,2,Mode=2,AP=1,Load=108,MinLoad=100,MaxLoad=120,IfFault=P Call Supervisor
35:InspectBolt,3,Mode=2,AP=1,Load=108,MinLoad=100,MaxLoad=120,IfFault=P Call Supervisor
36:InspectBolt,4,Mode=2,AP=1,Load=108,MinLoad=100,MaxLoad=120,IfFault=P Call Supervisor
37:InspectBolt,5,Mode=2,AP=1,Load=108,MinLoad=100,MaxLoad=120,IfFault=P Call Supervisor
38:InspectBolt,6,Mode=2,AP=1,Load=108,MinLoad=100,MaxLoad=120,IfFault=P Call Supervisor
39:InspectBolt,7,Mode=2,AP=1,Load=108,MinLoad=100,MaxLoad=120,IfFault=P Call Supervisor
40:InspectBolt,8,Mode=2,AP=1,Load=108,MinLoad=100,MaxLoad=120,IfFault=P Call Supervisor
41:InspectBolt,1,Mode=2,AP=1,Load=81,MinLoad=78,MaxLoad=108,IfOK=43,IfHI=43,IfFault=P Call Supervisor
42:TightenBolt,1,Mode=18,AP=1,Load=81,MinLoad=78,MaxLoad=95,MaxTorque=290,IfFault=P Call Supervisor
43:InspectBolt,5,Mode=2,AP=1,Load=81,MinLoad=78,MaxLoad=108,IfOK=45,IfHI=45,IfFault=P Call Supervisor
44:TightenBolt,5,Mode=18,AP=1,Load=81,MinLoad=78,MaxLoad=95,MaxTorque=290,IfFault=P Call Supervisor
45:InspectBolt,7,Mode=2,AP=1,Load=61,MinLoad=58,MaxLoad=108,IfOK=47,IfHI=47,IfFault=P Call Supervisor
46:TightenBolt,7,Mode=18,AP=1,Load=61,MinLoad=58,MaxLoad=95,MaxTorque=290,IfFault=P Call Supervisor
47:InspectBolt,3,Mode=2,AP=1,Load=81,MinLoad=78,MaxLoad=108,IfOK=49,IfHI=49,IfFault=P Call Supervisor
48:TightenBolt,3,Mode=18,AP=1,Load=81,MinLoad=78,MaxLoad=95,MaxTorque=290,IfFault=P Call Supervisor
49:InspectBolt,8,Mode=2,AP=1,Load=71,MinLoad=68,MaxLoad=108,IfOK=51,IfHI=51,IfFault=P Call Supervisor
50:TightenBolt,8,Mode=18,AP=1,Load=71,MinLoad=68,MaxLoad=95,MaxTorque=290,IfFault=P Call Supervisor
51:InspectBolt,4,Mode=2,AP=1,Load=81,MinLoad=78,MaxLoad=108,IfOK=53,IfHI=53,IfFault=P Call Supervisor
52:TightenBolt,4,Mode=18,AP=1,Load=81,MinLoad=78,MaxLoad=95,MaxTorque=290,IfFault=P Call Supervisor
53:InspectBolt,6,Mode=2,AP=1,Load=71,MinLoad=68,MaxLoad=108,IfOK=55,IfHI=55,IfFault=P Call Supervisor
54:TightenBolt,6,Mode=18,AP=1,Load=71,MinLoad=68,MaxLoad=95,MaxTorque=290,IfFault=P Call Supervisor
55:InspectBolt,2,Mode=2,AP=1,Load=81,MinLoad=78,MaxLoad=108,IfOK=57,IfHI=57,IfFault=P Call Supervisor
56:TightenBolt,2,Mode=18,AP=1,Load=81,MinLoad=78,MaxLoad=95,MaxTorque=290,IfFault=P Call Supervisor
57:InspectBolt,1,Mode=2,AP=1,Load=108,MinLoad=100,MaxLoad=120,IfFault=P Call Supervisor
58:InspectBolt,2,Mode=2,AP=1,Load=108,MinLoad=100,MaxLoad=120,IfFault=P Call Supervisor
59:InspectBolt,3,Mode=2,AP=1,Load=108,MinLoad=100,MaxLoad=120,IfFault=P Call Supervisor
60:InspectBolt,4,Mode=2,AP=1,Load=108,MinLoad=100,MaxLoad=120,IfFault=P Call Supervisor
61:InspectBolt,5,Mode=2,AP=1,Load=108,MinLoad=100,MaxLoad=120,IfFault=P Call Supervisor
62:InspectBolt,6,Mode=2,AP=1,Load=108,MinLoad=100,MaxLoad=120,IfFault=P Call Supervisor
63:InspectBolt,7,Mode=2,AP=1,Load=108,MinLoad=100,MaxLoad=120,IfFault=P Call Supervisor
64:InspectBolt,8,Mode=2,AP=1,Load=108,MinLoad=100,MaxLoad=120,IfFault=P Call Supervisor
65:InspectBolt,1,Mode=2,AP=1,Load=81,MinLoad=78,MaxLoad=108,IfOK=67,IfHI=67,IfFault=P Call Supervisor
66:TightenBolt,1,Mode=18,AP=1,Load=81,MinLoad=78,MaxLoad=95,MaxTorque=290,IfFault=P Call Supervisor
67:InspectBolt,5,Mode=2,AP=1,Load=81,MinLoad=78,MaxLoad=108,IfOK=69,IfHI=69,IfFault=P Call Supervisor
68:TightenBolt,5,Mode=18,AP=1,Load=81,MinLoad=78,MaxLoad=95,MaxTorque=290,IfFault=P Call Supervisor
69:InspectBolt,7,Mode=2,AP=1,Load=61,MinLoad=58,MaxLoad=108,IfOK=71,IfHI=71,IfFault=P Call Supervisor
70:TightenBolt,7,Mode=18,AP=1,Load=61,MinLoad=58,MaxLoad=95,MaxTorque=290,IfFault=P Call Supervisor
71:InspectBolt,3,Mode=2,AP=1,Load=81,MinLoad=78,MaxLoad=108,IfOK=73,IfHI=73,IfFault=P Call Supervisor
72:TightenBolt,3,Mode=18,AP=1,Load=81,MinLoad=78,MaxLoad=95,MaxTorque=290,IfFault=P Call Supervisor
73:InspectBolt,8,Mode=2,AP=1,Load=71,MinLoad=68,MaxLoad=108,IfOK=75,IfHI=75,IfFault=P Call Supervisor
74:TightenBolt,8,Mode=18,AP=1,Load=71,MinLoad=68,MaxLoad=95,MaxTorque=290,IfFault=P Call Supervisor
75:InspectBolt,4,Mode=2,AP=1,Load=81,MinLoad=78,MaxLoad=108,IfOK=77,IfHI=77,IfFault=P Call Supervisor
76:TightenBolt,4,Mode=18,AP=1,Load=81,MinLoad=78,MaxLoad=95,MaxTorque=290,IfFault=P Call Supervisor
77:InspectBolt,6,Mode=2,AP=1,Load=71,MinLoad=68,MaxLoad=108,IfOK=79,IfHI=79,IfFault=P Call Supervisor
78:TightenBolt,6,Mode=18,AP=1,Load=71,MinLoad=68,MaxLoad=95,MaxTorque=290,IfFault=P Call Supervisor
79:InspectBolt,2,Mode=2,AP=1,Load=81,MinLoad=78,MaxLoad=108,IfOK=81,IfHI=81,IfFault=P Call Supervisor
```

*Fig. 8B*

```
80:TightenBolt,2,Mode=18,AP=1,Load=81,MinLoad=78,MaxLoad=95,MaxTorque=290,IfFault=P Call Supervisor
81:InspectBolt,1,Mode=2,AP=1,Load=108,MinLoad=100,MaxLoad=120,IfFault=P Call Supervisor
82:InspectBolt,2,Mode=2,AP=1,Load=108,MinLoad=100,MaxLoad=120,IfFault=P Call Supervisor
83:InspectBolt,3,Mode=2,AP=1,Load=108,MinLoad=100,MaxLoad=120,IfFault=P Call Supervisor
84:InspectBolt,4,Mode=2,AP=1,Load=108,MinLoad=100,MaxLoad=120,IfFault=P Call Supervisor
85:InspectBolt,5,Mode=2,AP=1,Load=108,MinLoad=100,MaxLoad=120,IfFault=P Call Supervisor
86:InspectBolt,6,Mode=2,AP=1,Load=108,MinLoad=100,MaxLoad=120,IfFault=P Call Supervisor
87:InspectBolt,7,Mode=2,AP=1,Load=108,MinLoad=100,MaxLoad=120,IfFault=P Call Supervisor
88:InspectBolt,8,Mode=2,AP=1,Load=108,MinLoad=100,MaxLoad=120,IfFault=P Call Supervisor
89:InspectBolt,1,Mode=2,AP=1,Load=81,MinLoad=78,MaxLoad=108,IfOK=91,IfHI=91,IfFault=P Call Supervisor
90:TightenBolt,1,Mode=18,AP=1,Load=81,MinLoad=78,MaxLoad=95,MaxTorque=290,IfFault=P Call Supervisor
91:InspectBolt,5,Mode=2,AP=1,Load=81,MinLoad=78,MaxLoad=108,IfOK=93,IfHI=93,IfFault=P Call Supervisor
92:TightenBolt,5,Mode=18,AP=1,Load=81,MinLoad=78,MaxLoad=95,MaxTorque=290,IfFault=P Call Supervisor
93:InspectBolt,7,Mode=2,AP=1,Load=61,MinLoad=58,MaxLoad=108,IfOK=95,IfHI=95,IfFault=P Call Supervisor
94:TightenBolt,7,Mode=18,AP=1,Load=61,MinLoad=58,MaxLoad=95,MaxTorque=290,IfFault=P Call Supervisor
95:InspectBolt,3,Mode=2,AP=1,Load=81,MinLoad=78,MaxLoad=108,IfOK=97,IfHI=97,IfFault=P Call Supervisor
96:TightenBolt,3,Mode=18,AP=1,Load=81,MinLoad=78,MaxLoad=95,MaxTorque=290,IfFault=P Call Supervisor
97:InspectBolt,8,Mode=2,AP=1,Load=71,MinLoad=68,MaxLoad=108,IfOK=99,IfHI=99,IfFault=P Call Supervisor
98:TightenBolt,8,Mode=18,AP=1,Load=71,MinLoad=68,MaxLoad=95,MaxTorque=290,IfFault=P Call Supervisor
99:InspectBolt,4,Mode=2,AP=1,Load=81,MinLoad=78,MaxLoad=108,IfOK=101,IfHI=101,IfFault=P Call Supervisor
100:TightenBolt,4,Mode=18,AP=1,Load=81,MinLoad=78,MaxLoad=95,MaxTorque=290,IfFault=P Call Supervisor
101:InspectBolt,6,Mode=2,AP=1,Load=71,MinLoad=68,MaxLoad=108,IfOK=103,IfHI=103,IfFault=P Call Supervisor
102:TightenBolt,6,Mode=18,AP=1,Load=71,MinLoad=68,MaxLoad=95,MaxTorque=290,IfFault=P Call Supervisor
103:InspectBolt,2,Mode=2,AP=1,Load=81,MinLoad=78,MaxLoad=108,IfOK=105,IfHI=105,IfFault=P Call Supervisor
104:TightenBolt,2,Mode=18,AP=1,Load=81,MinLoad=78,MaxLoad=95,MaxTorque=290,IfFault=P Call Supervisor
105:InspectBolt,1,Mode=2,AP=1,Load=108,MinLoad=100,MaxLoad=120,IfFault=P Call Supervisor
106:InspectBolt,2,Mode=2,AP=1,Load=108,MinLoad=100,MaxLoad=120,IfFault=P Call Supervisor
107:InspectBolt,3,Mode=2,AP=1,Load=108,MinLoad=100,MaxLoad=120,IfFault=P Call Supervisor
108:InspectBolt,4,Mode=2,AP=1,Load=108,MinLoad=100,MaxLoad=120,IfFault=P Call Supervisor
109:InspectBolt,5,Mode=2,AP=1,Load=108,MinLoad=100,MaxLoad=120,IfFault=P Call Supervisor
110:InspectBolt,6,Mode=2,AP=1,Load=108,MinLoad=100,MaxLoad=120,IfFault=P Call Supervisor
111:InspectBolt,7,Mode=2,AP=1,Load=108,MinLoad=100,MaxLoad=120,IfFault=P Call Supervisor
112:InspectBolt,8,Mode=2,AP=1,Load=108,MinLoad=100,MaxLoad=120,IfFault=P Call Supervisor
113:InspectBolt,1,Mode=2,AP=1,Load=85,MinLoad=82,MaxLoad=120,IfOK=115,IfHI=115,IfFault=P Call Supervisor
114:TightenBolt,1,Mode=18,AP=1,Load=85,MinLoad=82,MaxLoad=120,MaxTorque=385,IfFault=P Call Supervisor
115:InspectBolt,5,Mode=2,AP=1,Load=105,MinLoad=102,MaxLoad=120,IfOK=117,IfHI=117,IfFault=P Call Supervisor
116:TightenBolt,5,Mode=18,AP=1,Load=105,MinLoad=102,MaxLoad=120,MaxTorque=385,IfFault=P Call Supervisor
117:InspectBolt,7,Mode=2,AP=1,Load=85,MinLoad=82,MaxLoad=120,IfOK=119,IfHI=119,IfFault=P Call Supervisor
118:TightenBolt,7,Mode=18,AP=1,Load=85,MinLoad=82,MaxLoad=120,MaxTorque=385,IfFault=P Call Supervisor
119:InspectBolt,3,Mode=2,AP=1,Load=105,MinLoad=102,MaxLoad=120,IfOK=121,IfHI=121,IfFault=P Call Supervisor
120:TightenBolt,3,Mode=18,AP=1,Load=105,MinLoad=102,MaxLoad=120,MaxTorque=385,IfFault=P Call Supervisor
121:InspectBolt,8,Mode=2,AP=1,Load=85,MinLoad=82,MaxLoad=120,IfOK=123,IfHI=123,IfFault=P Call Supervisor
122:TightenBolt,8,Mode=18,AP=1,Load=85,MinLoad=82,MaxLoad=120,MaxTorque=385,IfFault=P Call Supervisor
123:InspectBolt,4,Mode=2,AP=1,Load=105,MinLoad=102,MaxLoad=120,IfOK=125,IfHI=125,IfFault=P Call Supervisor
124:TightenBolt,4,Mode=18,AP=1,Load=105,MinLoad=102,MaxLoad=120,MaxTorque=385,IfFault=P Call Supervisor
125:InspectBolt,6,Mode=2,AP=1,Load=85,MinLoad=82,MaxLoad=120,IfOK=127,IfHI=127,IfFault=P Call Supervisor
126:TightenBolt,6,Mode=18,AP=1,Load=85,MinLoad=82,MaxLoad=120,MaxTorque=385,IfFault=P Call Supervisor
127:InspectBolt,2,Mode=2,AP=1,Load=105,MinLoad=102,MaxLoad=120,IfOK=129,IfHI=129,IfFault=P Call Supervisor
128:TightenBolt,2,Mode=18,AP=1,Load=105,MinLoad=102,MaxLoad=120,MaxTorque=385,IfFault=P Call Supervisor
129:InspectBolt,1,Mode=2,AP=1,Load=108,MinLoad=100,MaxLoad=120,IfFault=P Call Supervisor
130:InspectBolt,2,Mode=2,AP=1,Load=108,MinLoad=100,MaxLoad=120,IfFault=P Call Supervisor
131:InspectBolt,3,Mode=2,AP=1,Load=108,MinLoad=100,MaxLoad=120,IfFault=P Call Supervisor
132:InspectBolt,4,Mode=2,AP=1,Load=108,MinLoad=100,MaxLoad=120,IfFault=P Call Supervisor
133:InspectBolt,5,Mode=2,AP=1,Load=108,MinLoad=100,MaxLoad=120,IfFault=P Call Supervisor
134:InspectBolt,6,Mode=2,AP=1,Load=108,MinLoad=100,MaxLoad=120,IfFault=P Call Supervisor
135:InspectBolt,7,Mode=2,AP=1,Load=108,MinLoad=100,MaxLoad=120,IfFault=P Call Supervisor
136:InspectBolt,8,Mode=2,AP=1,Load=108,MinLoad=100,MaxLoad=120,IfFault=P Call Supervisor
137:InspectBolt,1,Mode=2,AP=1,Load=95,MinLoad=92,MaxLoad=120,IfOK=139,IfHI=139,IfFault=P Call Supervisor
138:TightenBolt,1,Mode=18,AP=1,Load=95,MinLoad=92,MaxLoad=120,MaxTorque=385,IfFault=P Call Supervisor
139:InspectBolt,5,Mode=2,AP=1,Load=105,MinLoad=102,MaxLoad=120,IfOK=141,IfHI=141,IfFault=P Call Supervisor
140:TightenBolt,5,Mode=18,AP=1,Load=105,MinLoad=102,MaxLoad=120,MaxTorque=385,IfFault=P Call Supervisor
141:InspectBolt,7,Mode=2,AP=1,Load=95,MinLoad=92,MaxLoad=120,IfOK=143,IfHI=143,IfFault=P Call Supervisor
142:TightenBolt,7,Mode=18,AP=1,Load=95,MinLoad=92,MaxLoad=120,MaxTorque=385,IfFault=P Call Supervisor
143:InspectBolt,3,Mode=2,AP=1,Load=105,MinLoad=102,MaxLoad=120,IfOK=145,IfHI=145,IfFault=P Call Supervisor
144:TightenBolt,3,Mode=18,AP=1,Load=105,MinLoad=102,MaxLoad=120,MaxTorque=385,IfFault=P Call Supervisor
145:InspectBolt,8,Mode=2,AP=1,Load=95,MinLoad=92,MaxLoad=120,IfOK=147,IfHI=147,IfFault=P Call Supervisor
146:TightenBolt,8,Mode=18,AP=1,Load=95,MinLoad=92,MaxLoad=120,MaxTorque=385,IfFault=P Call Supervisor
147:InspectBolt,4,Mode=2,AP=1,Load=105,MinLoad=102,MaxLoad=120,IfOK=149,IfHI=149,IfFault=P Call Supervisor
148:TightenBolt,4,Mode=18,AP=1,Load=105,MinLoad=102,MaxLoad=120,MaxTorque=385,IfFault=P Call Supervisor
149:InspectBolt,6,Mode=2,AP=1,Load=95,MinLoad=92,MaxLoad=120,IfOK=151,IfHI=151,IfFault=P Call Supervisor
150:TightenBolt,6,Mode=18,AP=1,Load=95,MinLoad=92,MaxLoad=120,MaxTorque=385,IfFault=P Call Supervisor
151:InspectBolt,2,Mode=2,AP=1,Load=105,MinLoad=102,MaxLoad=120,IfOK=153,IfHI=153,IfFault=P Call Supervisor
152:TightenBolt,2,Mode=18,AP=1,Load=105,MinLoad=102,MaxLoad=120,MaxTorque=385,IfFault=P Call Supervisor
153:InspectBolt,1,Mode=2,AP=1,Load=108,MinLoad=100,MaxLoad=120,IfFault=P Call Supervisor
154:InspectBolt,2,Mode=2,AP=1,Load=108,MinLoad=100,MaxLoad=120,IfFault=P Call Supervisor
155:InspectBolt,3,Mode=2,AP=1,Load=108,MinLoad=100,MaxLoad=120,IfFault=P Call Supervisor
156:InspectBolt,4,Mode=2,AP=1,Load=108,MinLoad=100,MaxLoad=120,IfFault=P Call Supervisor
157:InspectBolt,5,Mode=2,AP=1,Load=108,MinLoad=100,MaxLoad=120,IfFault=P Call Supervisor
158:InspectBolt,6,Mode=2,AP=1,Load=108,MinLoad=100,MaxLoad=120,IfFault=P Call Supervisor
159:InspectBolt,7,Mode=2,AP=1,Load=108,MinLoad=100,MaxLoad=120,IfFault=P Call Supervisor
160:InspectBolt,8,Mode=2,AP=1,Load=108,MinLoad=100,MaxLoad=120,IfFault=P Call Supervisor
```

*Fig. 8C*

```
161:InspectBolt,1,Mode=2,AP=1,Load=108,MinLoad=105,MaxLoad=120,IfOK=163,IfHI=163,IfFault=P Call Supervisor
162:TightenBolt,1,Mode=18,AP=1,Load=108,MinLoad=105,MaxLoad=120,MaxTorque=385,IfFault=P Call Supervisor
163:InspectBolt,2,Mode=2,AP=1,Load=108,MinLoad=105,MaxLoad=120,IfOK=165,IfHI=165,IfFault=P Call Supervisor
164:TightenBolt,2,Mode=18,AP=1,Load=108,MinLoad=105,MaxLoad=120,MaxTorque=385,IfFault=P Call Supervisor
165:InspectBolt,3,Mode=2,AP=1,Load=108,MinLoad=105,MaxLoad=120,IfOK=167,IfHI=167,IfFault=P Call Supervisor
166:TightenBolt,3,Mode=18,AP=1,Load=108,MinLoad=105,MaxLoad=120,MaxTorque=385,IfFault=P Call Supervisor
167:InspectBolt,4,Mode=2,AP=1,Load=108,MinLoad=105,MaxLoad=120,IfOK=169,IfHI=169,IfFault=P Call Supervisor
168:TightenBolt,4,Mode=18,AP=1,Load=108,MinLoad=105,MaxLoad=120,MaxTorque=385,IfFault=P Call Supervisor
169:InspectBolt,5,Mode=2,AP=1,Load=108,MinLoad=105,MaxLoad=120,IfOK=171,IfHI=171,IfFault=P Call Supervisor
170:TightenBolt,5,Mode=18,AP=1,Load=108,MinLoad=105,MaxLoad=120,MaxTorque=385,IfFault=P Call Supervisor
171:InspectBolt,6,Mode=2,AP=1,Load=108,MinLoad=105,MaxLoad=120,IfOK=173,IfHI=173,IfFault=P Call Supervisor
172:TightenBolt,6,Mode=18,AP=1,Load=108,MinLoad=105,MaxLoad=120,MaxTorque=385,IfFault=P Call Supervisor
173:InspectBolt,7,Mode=2,AP=1,Load=108,MinLoad=105,MaxLoad=120,IfOK=175,IfHI=175,IfFault=P Call Supervisor
174:TightenBolt,7,Mode=18,AP=1,Load=108,MinLoad=105,MaxLoad=120,MaxTorque=385,IfFault=P Call Supervisor
175:InspectBolt,8,Mode=2,AP=1,Load=108,MinLoad=105,MaxLoad=120,IfOK=177,IfHI=177,IfFault=P Call Supervisor
176:TightenBolt,8,Mode=18,AP=1,Load=108,MinLoad=105,MaxLoad=120,MaxTorque=385,IfFault=P Call Supervisor
177:InspectBolt,1,Mode=2,AP=1,Load=108,MinLoad=100,MaxLoad=120,IfFault=P Call Supervisor
178:InspectBolt,2,Mode=2,AP=1,Load=108,MinLoad=100,MaxLoad=120,IfFault=P Call Supervisor
179:InspectBolt,3,Mode=2,AP=1,Load=108,MinLoad=100,MaxLoad=120,IfFault=P Call Supervisor
180:InspectBolt,4,Mode=2,AP=1,Load=108,MinLoad=100,MaxLoad=120,IfFault=P Call Supervisor
181:InspectBolt,5,Mode=2,AP=1,Load=108,MinLoad=100,MaxLoad=120,IfFault=P Call Supervisor
182:InspectBolt,6,Mode=2,AP=1,Load=108,MinLoad=100,MaxLoad=120,IfFault=P Call Supervisor
183:InspectBolt,7,Mode=2,AP=1,Load=108,MinLoad=100,MaxLoad=120,IfFault=P Call Supervisor
184:InspectBolt,8,Mode=2,AP=1,Load=108,MinLoad=100,MaxLoad=120,IfFault=P Call Supervisor
185:InspectBolt,1,Mode=2,AP=1,Load=108,MinLoad=105,MaxLoad=120,IfOK=187,IfHI=187,IfFault=P Call Supervisor
186:TightenBolt,1,Mode=18,AP=1,Load=108,MinLoad=105,MaxLoad=120,MaxTorque=385,IfFault=P Call Supervisor
187:InspectBolt,2,Mode=2,AP=1,Load=108,MinLoad=105,MaxLoad=120,IfOK=189,IfHI=189,IfFault=P Call Supervisor
188:TightenBolt,2,Mode=18,AP=1,Load=108,MinLoad=105,MaxLoad=120,MaxTorque=385,IfFault=P Call Supervisor
189:InspectBolt,3,Mode=2,AP=1,Load=108,MinLoad=105,MaxLoad=120,IfOK=191,IfHI=191,IfFault=P Call Supervisor
190:TightenBolt,3,Mode=18,AP=1,Load=108,MinLoad=105,MaxLoad=120,MaxTorque=385,IfFault=P Call Supervisor
191:InspectBolt,4,Mode=2,AP=1,Load=108,MinLoad=105,MaxLoad=120,IfOK=193,IfHI=193,IfFault=P Call Supervisor
192:TightenBolt,4,Mode=18,AP=1,Load=108,MinLoad=105,MaxLoad=120,MaxTorque=385,IfFault=P Call Supervisor
193:InspectBolt,5,Mode=2,AP=1,Load=108,MinLoad=105,MaxLoad=120,IfOK=195,IfHI=195,IfFault=P Call Supervisor
194:TightenBolt,5,Mode=18,AP=1,Load=108,MinLoad=105,MaxLoad=120,MaxTorque=385,IfFault=P Call Supervisor
195:InspectBolt,6,Mode=2,AP=1,Load=108,MinLoad=105,MaxLoad=120,IfOK=197,IfHI=197,IfFault=P Call Supervisor
196:TightenBolt,6,Mode=18,AP=1,Load=108,MinLoad=105,MaxLoad=120,MaxTorque=385,IfFault=P Call Supervisor
197:InspectBolt,7,Mode=2,AP=1,Load=108,MinLoad=105,MaxLoad=120,IfOK=199,IfHI=199,IfFault=P Call Supervisor
198:TightenBolt,7,Mode=18,AP=1,Load=108,MinLoad=105,MaxLoad=120,MaxTorque=385,IfFault=P Call Supervisor
199:InspectBolt,8,Mode=2,AP=1,Load=108,MinLoad=105,MaxLoad=120,IfOK=201,IfHI=201,IfFault=P Call Supervisor
200:TightenBolt,8,Mode=18,AP=1,Load=108,MinLoad=105,MaxLoad=120,MaxTorque=385,IfFault=P Call Supervisor
201:InspectBolt,1,Mode=2,AP=1,Load=108,MinLoad=100,MaxLoad=120,IfFault=P Call Supervisor
202:InspectBolt,2,Mode=2,AP=1,Load=108,MinLoad=100,MaxLoad=120,IfFault=P Call Supervisor
203:InspectBolt,3,Mode=2,AP=1,Load=108,MinLoad=100,MaxLoad=120,IfFault=P Call Supervisor
204:InspectBolt,4,Mode=2,AP=1,Load=108,MinLoad=100,MaxLoad=120,IfFault=P Call Supervisor
205:InspectBolt,5,Mode=2,AP=1,Load=108,MinLoad=100,MaxLoad=120,IfFault=P Call Supervisor
206:InspectBolt,6,Mode=2,AP=1,Load=108,MinLoad=100,MaxLoad=120,IfFault=P Call Supervisor
207:InspectBolt,7,Mode=2,AP=1,Load=108,MinLoad=100,MaxLoad=120,IfFault=P Call Supervisor
208:InspectBolt,8,Mode=2,AP=1,Load=108,MinLoad=100,MaxLoad=120,IfFault=P Call Supervisor
209:EndPIP
```

Fig. 9A

Mechanic ID: Phung Mai
Component ID: API 6A BX151
IP Number: 214
Time/Date: 4/26/10 9:01:21 AM

61

50

| IP | Bolt | BoltID | Part No. | Init Load kN | Load kN | Torque Nm | Temp C | Status | Date | Time |
|---|---|---|---|---|---|---|---|---|---|---|
| Scan | 1 | 100000792549 | LCT Flange Dem | | | | | | 4/26/2010 | 5:35:26 PM |
| Scan | 2 | 100000793418 | LCT Flange Dem | | | | | | 4/26/2010 | 5:35:30 PM |
| Scan | 3 | 100000792648 | LCT Flange Dem | | | | | | 4/26/2010 | 5:35:35 PM |
| Scan | 4 | 100000822369 | LCT Flange Dem | | | | | | 4/26/2010 | 5:35:39 PM |
| Scan | 5 | 100000822402 | LCT Flange Dem | | | | | | 4/26/2010 | 5:35:45 PM |
| Scan | 6 | 100000793429 | LCT Flange Dem | | | | | | 4/26/2010 | 5:35:49 PM |
| Scan | 7 | 100000793264 | LCT Flange Dem | | | | | | 4/26/2010 | 5:35:52 PM |
| Scan | 8 | 100000793693 | LCT Flange Dem | | | | | | 4/26/2010 | 5:35:56 PM |
| Inspect | 1 | 100000792549 | LCT Flange Dem | | 14.3 | | 22.0 | LO | 4/26/2010 | 5:36:56 PM |
| Inspect | 2 | 100000793418 | LCT Flange Dem | | 15.7 | | 22.0 | LO | 4/26/2010 | 5:36:56 PM |
| Inspect | 3 | 100000792648 | LCT Flange Dem | | 17.2 | | 22.0 | LO | 4/26/2010 | 5:36:58 PM |
| Inspect | 4 | 100000822369 | LCT Flange Dem | | 13.2 | | 22.0 | LO | 4/26/2010 | 5:36:58 PM |
| Inspect | 5 | 100000822402 | LCT Flange Dem | | 16.9 | | 22.0 | LO | 4/26/2010 | 5:36:59 PM |
| Inspect | 6 | 100000793429 | LCT Flange Dem | | 20.0 | | 22.0 | LO | 4/26/2010 | 5:37:00 PM |
| Inspect | 7 | 100000793264 | LCT Flange Dem | | 15.9 | | 22.0 | LO | 4/26/2010 | 5:37:00 PM |
| Inspect | 8 | 100000793693 | LCT Flange Dem | | 20.7 | | 22.0 | LO | 4/26/2010 | 5:37:01 PM |
| Inspect | 1 | 100000792549 | LCT Flange Dem | | 14.4 | | 22.0 | LO | 4/26/2010 | 5:37:02 PM |
| Tighten | 1 | 100000792549 | LCT Flange Dem | 14.5 | 29.4 | 0.0 | 21.8 | OK | 4/26/2010 | 5:37:10 PM |
| Inspect | 5 | 100000822402 | LCT Flange Dem | | 19.2 | | 21.8 | LO | 4/26/2010 | 5:37:11 PM |
| Tighten | 5 | 100000822402 | LCT Flange Dem | 18.6 | 29.1 | 0.0 | 21.7 | OK | 4/26/2010 | 5:37:17 PM |
| Inspect | 7 | 100000793264 | LCT Flange Dem | | 15.9 | | 21.8 | LO | 4/26/2010 | 5:37:18 PM |
| Tighten | 7 | 100000793264 | LCT Flange Dem | 15.3 | 28.1 | 0.0 | 21.7 | OK | 4/26/2010 | 5:37:24 PM |
| Inspect | 3 | 100000792648 | LCT Flange Dem | | 19.1 | | 21.8 | LO | 4/26/2010 | 5:37:25 PM |
| Tighten | 3 | 100000792648 | LCT Flange Dem | 18.9 | 27.3 | 0.0 | 21.7 | OK | 4/26/2010 | 5:37:32 PM |
| Inspect | 8 | 100000793693 | LCT Flange Dem | | 13.1 | | 22.0 | LO | 4/26/2010 | 5:37:32 PM |
| Tighten | 8 | 100000793693 | LCT Flange Dem | 12.9 | 28.6 | 0.0 | 21.8 | OK | 4/26/2010 | 5:37:39 PM |
| Inspect | 4 | 100000822369 | LCT Flange Dem | | 14.5 | | 21.8 | LO | 4/26/2010 | 5:37:39 PM |
| Tighten | 4 | 100000822369 | LCT Flange Dem | 14.1 | 27.3 | 0.0 | 21.6 | OK | 4/26/2010 | 5:37:45 PM |
| Inspect | 6 | 100000793429 | LCT Flange Dem | | 14.6 | | 21.9 | LO | 4/26/2010 | 5:37:46 PM |
| Tighten | 6 | 100000793429 | LCT Flange Dem | 14.4 | 27.8 | 0.0 | 21.7 | OK | 4/26/2010 | 5:37:51 PM |
| Inspect | 2 | 100000793418 | LCT Flange Dem | | 12.7 | | 21.8 | LO | 4/26/2010 | 5:37:52 PM |
| Tighten | 2 | 100000793418 | LCT Flange Dem | 12.6 | 28.8 | 0.0 | 21.7 | OK | 4/26/2010 | 5:37:59 PM |
| Inspect | 1 | 100000792549 | LCT Flange Dem | | 19.5 | | 22.0 | LO | 4/26/2010 | 5:38:00 PM |
| Inspect | 2 | 100000793418 | LCT Flange Dem | | 27.8 | | 22.0 | LO | 4/26/2010 | 5:38:01 PM |
| Inspect | 3 | 100000792648 | LCT Flange Dem | | 19.1 | | 22.0 | LO | 4/26/2010 | 5:38:01 PM |
| Inspect | 4 | 100000822369 | LCT Flange Dem | | 24.4 | | 22.0 | LO | 4/26/2010 | 5:38:02 PM |
| Inspect | 5 | 100000822402 | LCT Flange Dem | | 22.0 | | 22.0 | LO | 4/26/2010 | 5:38:03 PM |
| Inspect | 6 | 100000793429 | LCT Flange Dem | | 29.1 | | 22.0 | LO | 4/26/2010 | 5:38:04 PM |
| Inspect | 7 | 100000793264 | LCT Flange Dem | | 19.3 | | 22.0 | LO | 4/26/2010 | 5:38:04 PM |
| Inspect | 8 | 100000793693 | LCT Flange Dem | | 27.3 | | 22.0 | LO | 4/26/2010 | 5:38:05 PM |
| Inspect | 1 | 100000792549 | LCT Flange Dem | | 19.0 | | 22.0 | LO | 4/26/2010 | 5:38:06 PM |
| Tighten | 1 | 100000792549 | LCT Flange Dem | 18.9 | 81.9 | 0.0 | 21.8 | OK | 4/26/2010 | 5:38:12 PM |
| Inspect | 5 | 100000822402 | LCT Flange Dem | | 33.4 | | 21.9 | LO | 4/26/2010 | 5:38:13 PM |
| Tighten | 5 | 100000822402 | LCT Flange Dem | 32.9 | 81.7 | 0.0 | 21.7 | OK | 4/26/2010 | 5:38:20 PM |
| Inspect | 7 | 100000793264 | LCT Flange Dem | | 11.3 | | 22.0 | LO | 4/26/2010 | 5:38:21 PM |
| Tighten | 7 | 100000793264 | LCT Flange Dem | 11.1 | 61.4 | 0.0 | 21.7 | OK | 4/26/2010 | 5:38:28 PM |
| Inspect | 3 | 100000792648 | LCT Flange Dem | | 25.5 | | 21.8 | LO | 4/26/2010 | 5:38:29 PM |
| Tighten | 3 | 100000792648 | LCT Flange Dem | 24.8 | 82.8 | 0.0 | 21.6 | OK | 4/26/2010 | 5:38:37 PM |
| Inspect | 8 | 100000793693 | LCT Flange Dem | | 0.3 | | 22.0 | LO | 4/26/2010 | 5:38:38 PM |
| Tighten | 8 | 100000793693 | LCT Flange Dem | 0.4 | 71.1 | 0.0 | 21.8 | OK | 4/26/2010 | 5:38:45 PM |
| Inspect | 4 | 100000822369 | LCT Flange Dem | | 3.2 | | 21.8 | LO | 4/26/2010 | 5:38:46 PM |
| Tighten | 4 | 100000822369 | LCT Flange Dem | 2.6 | 82.4 | 0.0 | 21.7 | OK | 4/26/2010 | 5:38:53 PM |
| Inspect | 6 | 100000793429 | LCT Flange Dem | | 1.5 | | 21.9 | LO | 4/26/2010 | 5:38:54 PM |
| Tighten | 6 | 100000793429 | LCT Flange Dem | 1.7 | 71.8 | 0.0 | 21.8 | OK | 4/26/2010 | 5:39:01 PM |
| Inspect | 2 | 100000793418 | LCT Flange Dem | | 1.2 | | 22.0 | LO | 4/26/2010 | 5:39:02 PM |
| Tighten | 2 | 100000793418 | LCT Flange Dem | 1.3 | 81.1 | 0.0 | 21.7 | OK | 4/26/2010 | 5:39:10 PM |
| Inspect | 1 | 100000792549 | LCT Flange Dem | | 7.6 | | 21.9 | LO | 4/26/2010 | 5:39:11 PM |
| Inspect | 2 | 100000793418 | LCT Flange Dem | | 81.7 | | 22.0 | LO | 4/26/2010 | 5:39:12 PM |
| Inspect | 3 | 100000792648 | LCT Flange Dem | | 18.4 | | 22.0 | LO | 4/26/2010 | 5:39:12 PM |
| Inspect | 4 | 100000822369 | LCT Flange Dem | | 51.7 | | 22.0 | LO | 4/26/2010 | 5:39:13 PM |
| Inspect | 5 | 100000822402 | LCT Flange Dem | | 7.1 | | 22.0 | LO | 4/26/2010 | 5:39:14 PM |
| Inspect | 6 | 100000793429 | LCT Flange Dem | | 89.5 | | 22.0 | LO | 4/26/2010 | 5:39:15 PM |
| Inspect | 7 | 100000793264 | LCT Flange Dem | | 12.0 | | 22.0 | LO | 4/26/2010 | 5:39:15 PM |
| Inspect | 8 | 100000793693 | LCT Flange Dem | | 58.2 | | 22.0 | LO | 4/26/2010 | 5:39:16 PM |
| Inspect | 1 | 100000792549 | LCT Flange Dem | | 6.7 | | 22.0 | LO | 4/26/2010 | 5:39:17 PM |
| Tighten | 1 | 100000792549 | LCT Flange Dem | 6.6 | 81.8 | 0.0 | 21.7 | OK | 4/26/2010 | 5:39:24 PM |
| Inspect | 5 | 100000822402 | LCT Flange Dem | | 9.9 | | 21.8 | LO | 4/26/2010 | 5:39:25 PM |
| Tighten | 5 | 100000822402 | LCT Flange Dem | 9.3 | 81.2 | 0.0 | 21.7 | OK | 4/26/2010 | 5:39:32 PM |
| Inspect | 7 | 100000793264 | LCT Flange Dem | | 7.3 | | 22.0 | LO | 4/26/2010 | 5:39:33 PM |
| Tighten | 7 | 100000793264 | LCT Flange Dem | 7.0 | 61.3 | 0.0 | 21.7 | OK | 4/26/2010 | 5:39:39 PM |
| Inspect | 3 | 100000792648 | LCT Flange Dem | | 16.6 | | 22.0 | LO | 4/26/2010 | 5:39:40 PM |
| Tighten | 3 | 100000792648 | LCT Flange Dem | 16.5 | 82.1 | 0.0 | 21.7 | OK | 4/26/2010 | 5:39:47 PM |
| Inspect | 8 | 100000793693 | LCT Flange Dem | | 9.2 | | 22.0 | LO | 4/26/2010 | 5:39:48 PM |

51 52 53 54 55 56

*Fig. 9B*

| | | | | | | | | | | | | |
|---|---|---|---|---|---|---|---|---|---|---|---|---|
| Tig | Tighten | 8 | 100000793693 | LCT Flange Dem | 8.6 | 71.8 | 0.0 | 21.6 | OK | 4/26/2010 | 5:39:55 | PM |
| Ins | Inspect | 4 | 100000822369 | LCT Flange Dem | | 15.2 | | 21.8 | LO | 4/26/2010 | 5:39:56 | PM |
| Tig | Tighten | 4 | 100000822369 | LCT Flange Dem | 14.6 | 82.1 | 0.0 | 21.7 | OK | 4/26/2010 | 5:40:02 | PM |
| Ins | Inspect | 6 | 100000793429 | LCT Flange Dem | | 28.9 | | 22.0 | LO | 4/26/2010 | 5:40:03 | PM |
| Tig | Tighten | 6 | 100000793429 | LCT Flange Dem | 27.9 | 71.7 | 0.0 | 21.7 | OK | 4/26/2010 | 5:40:09 | PM |
| Ins | Inspect | 2 | 100000793418 | LCT Flange Dem | | 22.1 | | 21.8 | LO | 4/26/2010 | 5:40:10 | PM |
| Tig | Tighten | 2 | 100000793418 | LCT Flange Dem | 21.3 | 81.7 | 0.0 | 21.7 | OK | 4/26/2010 | 5:40:16 | PM |
| Ins | Inspect | 1 | 100000792549 | LCT Flange Dem | | 26.9 | | 21.9 | LO | 4/26/2010 | 5:40:17 | PM |
| Ins | Inspect | 2 | 100000793418 | LCT Flange Dem | | 80.1 | | 22.0 | LO | 4/26/2010 | 5:40:17 | PM |
| Ins | Inspect | 3 | 100000792648 | LCT Flange Dem | | 29.7 | | 21.9 | LO | 4/26/2010 | 5:40:18 | PM |
| Ins | Inspect | 4 | 100000822369 | LCT Flange Dem | | 68.3 | | 21.8 | LO | 4/26/2010 | 5:40:19 | PM |
| Ins | Inspect | 5 | 100000822402 | LCT Flange Dem | | 25.4 | | 21.9 | LO | 4/26/2010 | 5:40:20 | PM |
| Ins | Inspect | 6 | 100000793429 | LCT Flange Dem | | 79.1 | | 21.9 | LO | 4/26/2010 | 5:40:21 | PM |
| Ins | Inspect | 7 | 100000793264 | LCT Flange Dem | | 30.2 | | 21.9 | LO | 4/26/2010 | 5:40:21 | PM |
| Ins | Inspect | 8 | 100000793693 | LCT Flange Dem | | 68.5 | | 22.0 | LO | 4/26/2010 | 5:40:22 | PM |
| Tig | Inspect | 1 | 100000792549 | LCT Flange Dem | | 25.5 | | 21.9 | LO | 4/26/2010 | 5:40:23 | PM |
| Ins | Tighten | 1 | 100000792549 | LCT Flange Dem | 25.3 | 81.3 | 0.0 | 21.7 | OK | 4/26/2010 | 5:40:29 | PM |
| Tig | Inspect | 5 | 100000822402 | LCT Flange Dem | | 30.9 | | 22.0 | LO | 4/26/2010 | 5:40:30 | PM |
| Ins | Tighten | 5 | 100000822402 | LCT Flange Dem | 30.7 | 82.6 | 0.0 | 21.7 | OK | 4/26/2010 | 5:40:37 | PM |
| Tig | Inspect | 7 | 100000793264 | LCT Flange Dem | | 23.6 | | 22.0 | LO | 4/26/2010 | 5:40:38 | PM |
| Ins | Tighten | 7 | 100000793264 | LCT Flange Dem | 23.2 | 63.1 | 0.0 | 21.7 | OK | 4/26/2010 | 5:40:43 | PM |
| Tig | Inspect | 3 | 100000792648 | LCT Flange Dem | | 26.9 | | 21.8 | LO | 4/26/2010 | 5:40:44 | PM |
| Ins | Tighten | 3 | 100000792648 | LCT Flange Dem | 26.3 | 82.1 | 0.0 | 21.7 | OK | 4/26/2010 | 5:40:51 | PM |
| Tig | Inspect | 8 | 100000793693 | LCT Flange Dem | | 34.7 | | 22.0 | LO | 4/26/2010 | 5:40:51 | PM |
| Ins | Tighten | 8 | 100000793693 | LCT Flange Dem | 34.4 | 71.9 | 0.0 | 21.7 | OK | 4/26/2010 | 5:40:57 | PM |
| Tig | Inspect | 4 | 100000822369 | LCT Flange Dem | | 33.1 | | 21.8 | LO | 4/26/2010 | 5:40:57 | PM |
| Ins | Tighten | 4 | 100000822369 | LCT Flange Dem | 32.3 | 83.0 | 0.0 | 21.6 | OK | 4/26/2010 | 5:41:05 | PM |
| Tig | Inspect | 6 | 100000793429 | LCT Flange Dem | | 39.2 | | 21.9 | LO | 4/26/2010 | 5:41:05 | PM |
| Ins | Tighten | 6 | 100000793429 | LCT Flange Dem | 38.3 | 70.7 | 0.0 | 21.6 | OK | 4/26/2010 | 5:41:12 | PM |
| Tig | Inspect | 2 | 100000793418 | LCT Flange Dem | | 32.3 | | 22.0 | LO | 4/26/2010 | 5:41:13 | PM |
| Ins | Tighten | 2 | 100000793418 | LCT Flange Dem | 32.3 | 81.9 | 0.0 | 21.6 | OK | 4/26/2010 | 5:41:19 | PM |
| Ins | Inspect | 1 | 100000792549 | LCT Flange Dem | | 41.7 | | 21.8 | LO | 4/26/2010 | 5:41:20 | PM |
| Ins | Inspect | 2 | 100000793418 | LCT Flange Dem | | 80.2 | | 22.0 | LO | 4/26/2010 | 5:41:21 | PM |
| Ins | Inspect | 3 | 100000792648 | LCT Flange Dem | | 38.8 | | 22.0 | LO | 4/26/2010 | 5:41:22 | PM |
| Ins | Inspect | 4 | 100000822369 | LCT Flange Dem | | 71.8 | | 21.9 | LO | 4/26/2010 | 5:41:23 | PM |
| Ins | Inspect | 5 | 100000822402 | LCT Flange Dem | | 40.0 | | 21.9 | LO | 4/26/2010 | 5:41:23 | PM |
| Ins | Inspect | 6 | 100000793429 | LCT Flange Dem | | 76.0 | | 21.9 | LO | 4/26/2010 | 5:41:24 | PM |
| Ins | Inspect | 7 | 100000793264 | LCT Flange Dem | | 41.5 | | 21.9 | LO | 4/26/2010 | 5:41:25 | PM |
| Ins | Inspect | 8 | 100000793693 | LCT Flange Dem | | 69.3 | | 22.0 | LO | 4/26/2010 | 5:41:26 | PM |
| Tig | Inspect | 1 | 100000792549 | LCT Flange Dem | | 39.7 | | 21.9 | LO | 4/26/2010 | 5:41:27 | PM |
| Ins | Tighten | 1 | 100000792549 | LCT Flange Dem | 39.2 | 86.5 | 0.0 | 21.6 | OK | 4/26/2010 | 5:41:32 | PM |
| Tig | Inspect | 5 | 100000822402 | LCT Flange Dem | | 45.0 | | 21.8 | LO | 4/26/2010 | 5:41:33 | PM |
| Ins | Tighten | 5 | 100000822402 | LCT Flange Dem | 44.1 | 106.0 | 0.0 | 21.6 | OK | 4/26/2010 | 5:41:40 | PM |
| Tig | Inspect | 7 | 100000793264 | LCT Flange Dem | | 35.4 | | 21.8 | LO | 4/26/2010 | 5:41:40 | PM |
| Ins | Tighten | 7 | 100000793264 | LCT Flange Dem | 34.2 | 88.1 | 0.0 | 21.6 | OK | 4/26/2010 | 5:41:46 | PM |
| Tig | Inspect | 3 | 100000792648 | LCT Flange Dem | | 35.6 | | 21.8 | LO | 4/26/2010 | 5:41:47 | PM |
| Ins | Tighten | 3 | 100000792648 | LCT Flange Dem | 35.2 | 108.5 | 0.0 | 21.6 | OK | 4/26/2010 | 5:41:53 | PM |
| Tig | Inspect | 8 | 100000793693 | LCT Flange Dem | | 47.8 | | 21.8 | LO | 4/26/2010 | 5:41:54 | PM |
| Ins | Tighten | 8 | 100000793693 | LCT Flange Dem | 47.2 | 89.0 | 0.0 | 21.6 | OK | 4/26/2010 | 5:41:59 | PM |
| Tig | Inspect | 4 | 100000822369 | LCT Flange Dem | | 42.3 | | 21.8 | LO | 4/26/2010 | 5:42:00 | PM |
| Ins | Tighten | 4 | 100000822369 | LCT Flange Dem | 42.0 | 108.7 | 0.0 | 21.7 | OK | 4/26/2010 | 5:42:06 | PM |
| Tig | Inspect | 6 | 100000793429 | LCT Flange Dem | | 47.0 | | 21.8 | LO | 4/26/2010 | 5:42:07 | PM |
| Ins | Tighten | 6 | 100000793429 | LCT Flange Dem | 46.8 | 89.5 | 0.0 | 21.6 | OK | 4/26/2010 | 5:42:12 | PM |
| Tig | Inspect | 2 | 100000793418 | LCT Flange Dem | | 59.7 | | 21.9 | LO | 4/26/2010 | 5:42:12 | PM |
| Ins | Tighten | 2 | 100000793418 | LCT Flange Dem | 59.7 | 108.7 | 0.0 | 21.6 | OK | 4/26/2010 | 5:42:19 | PM |
| Ins | Inspect | 1 | 100000792549 | LCT Flange Dem | | 89.1 | | 21.8 | LO | 4/26/2010 | 5:42:19 | PM |
| Ins | Inspect | 2 | 100000793418 | LCT Flange Dem | | 108.7 | | 21.9 | OK | 4/26/2010 | 5:42:20 | PM |
| Ins | Inspect | 3 | 100000792648 | LCT Flange Dem | | 96.7 | | 21.8 | LO | 4/26/2010 | 5:42:21 | PM |
| Ins | Inspect | 4 | 100000822369 | LCT Flange Dem | | 110.5 | | 21.9 | OK | 4/26/2010 | 5:42:22 | PM |
| Ins | Inspect | 5 | 100000822402 | LCT Flange Dem | | 97.4 | | 21.9 | LO | 4/26/2010 | 5:42:23 | PM |
| Ins | Inspect | 6 | 100000793429 | LCT Flange Dem | | 90.7 | | 21.8 | LO | 4/26/2010 | 5:42:23 | PM |
| Ins | Inspect | 7 | 100000793264 | LCT Flange Dem | | 85.2 | | 21.8 | LO | 4/26/2010 | 5:42:24 | PM |
| Ins | Inspect | 8 | 100000793693 | LCT Flange Dem | | 93.1 | | 21.9 | LO | 4/26/2010 | 5:42:25 | PM |
| Ins | Inspect | 1 | 100000792549 | LCT Flange Dem | | 69.1 | | 21.8 | LO | 4/26/2010 | 5:42:26 | PM |
| Tig | Tighten | 1 | 100000792549 | LCT Flange Dem | 88.8 | 98.9 | 0.0 | 21.6 | OK | 4/26/2010 | 5:42:31 | PM |
| Ins | Inspect | 5 | 100000822402 | LCT Flange Dem | | 97.8 | | 21.8 | LO | 4/26/2010 | 5:42:32 | PM |
| Tig | Tighten | 5 | 100000822402 | LCT Flange Dem | 97.5 | 108.1 | 0.0 | 21.6 | OK | 4/26/2010 | 5:42:37 | PM |
| Ins | Inspect | 7 | 100000793264 | LCT Flange Dem | | 85.5 | | 21.8 | LO | 4/26/2010 | 5:42:38 | PM |
| Tig | Tighten | 7 | 100000793264 | LCT Flange Dem | 84.7 | 99.1 | 0.0 | 21.6 | OK | 4/26/2010 | 5:42:43 | PM |
| Ins | Inspect | 3 | 100000792648 | LCT Flange Dem | | 97.1 | | 21.9 | LO | 4/26/2010 | 5:42:44 | PM |
| Tig | Tighten | 3 | 100000792648 | LCT Flange Dem | 97.1 | 109.3 | 0.0 | 21.6 | OK | 4/26/2010 | 5:42:48 | PM |
| Ins | Inspect | 8 | 100000793693 | LCT Flange Dem | | 91.5 | | 21.8 | LO | 4/26/2010 | 5:42:49 | PM |
| Tig | Tighten | 8 | 100000793693 | LCT Flange Dem | 91.1 | 97.9 | 0.0 | 21.6 | OK | 4/26/2010 | 5:42:54 | PM |
| Ins | Inspect | 4 | 100000822369 | LCT Flange Dem | | 108.9 | | 21.8 | OK | 4/26/2010 | 5:42:55 | PM |
| Ins | Inspect | 6 | 100000793429 | LCT Flange Dem | | 89.0 | | 21.9 | LO | 4/26/2010 | 5:42:55 | PM |
| Tig | Tighten | 6 | 100000793429 | LCT Flange Dem | 88.9 | 99.0 | 0.0 | 21.6 | OK | 4/26/2010 | 5:43:01 | PM |
| Ins | Inspect | 2 | 100000793418 | LCT Flange Dem | | 106.9 | | 21.9 | OK | 4/26/2010 | 5:43:02 | PM |
| Ins | Inspect | 1 | 100000792549 | LCT Flange Dem | | 98.8 | | 21.9 | LO | 4/26/2010 | 5:43:03 | PM |
| Ins | Inspect | 2 | 100000793418 | LCT Flange Dem | | 107.0 | | 21.9 | OK | 4/26/2010 | 5:43:04 | PM |
| Ins | Inspect | 3 | 100000792648 | LCT Flange Dem | | 109.7 | | 21.9 | OK | 4/26/2010 | 5:43:05 | PM |
| Ins | Inspect | 4 | 100000822369 | LCT Flange Dem | | 108.9 | | 21.9 | OK | 4/26/2010 | 5:43:05 | PM |

Fig. 9C

| | | | | | | | | | | | | |
|---|---|---|---|---|---|---|---|---|---|---|---|---|
| Inspect | 5 | 100000822402 | LCT | Flange | Dem | | 107.9 | | 21.9 | OK | 4/26/2010 | 5:43:06 PM |
| Inspect | 6 | 100000793429 | LCT | Flange | Dem | | 99.7 | | 21.8 | LO | 4/26/2010 | 5:43:07 PM |
| Inspect | 7 | 100000793264 | LCT | Flange | Dem | | 98.1 | | 21.9 | LO | 4/26/2010 | 5:43:08 PM |
| Inspect | 8 | 100000793693 | LCT | Flange | Dem | | 98.9 | | 21.9 | LO | 4/26/2010 | 5:43:09 PM |
| Inspect | 1 | 100000792549 | LCT | Flange | Dem | | 99.0 | | 21.8 | LO | 4/26/2010 | 5:43:10 PM |
| Tighten | 1 | 100000792549 | LCT | Flange | Dem | 98.6 | 111.5 | 0.0 | 21.6 | OK | 4/26/2010 | 5:43:15 PM |
| Inspect | 2 | 100000793418 | LCT | Flange | Dem | | 105.6 | | 21.8 | OK | 4/26/2010 | 5:43:16 PM |
| Inspect | 3 | 100000792648 | LCT | Flange | Dem | | 110.2 | | 21.8 | OK | 4/26/2010 | 5:43:16 PM |
| Inspect | 4 | 100000822369 | LCT | Flange | Dem | | 109.2 | | 21.9 | OK | 4/26/2010 | 5:43:17 PM |
| Inspect | 5 | 100000822402 | LCT | Flange | Dem | | 108.1 | | 21.9 | OK | 4/26/2010 | 5:43:18 PM |
| Inspect | 6 | 100000793429 | LCT | Flange | Dem | | 99.8 | | 21.9 | LO | 4/26/2010 | 5:43:19 PM |
| Tighten | 6 | 100000793429 | LCT | Flange | Dem | 99.7 | 110.4 | 0.0 | 21.6 | OK | 4/26/2010 | 5:43:24 PM |
| Inspect | 7 | 100000793264 | LCT | Flange | Dem | | 97.4 | | 21.8 | LO | 4/26/2010 | 5:43:25 PM |
| Tighten | 7 | 100000793264 | LCT | Flange | Dem | 97.4 | 111.3 | 0.0 | 21.6 | OK | 4/26/2010 | 5:43:31 PM |
| Inspect | 8 | 100000793693 | LCT | Flange | Dem | | 96.8 | | 21.8 | LO | 4/26/2010 | 5:43:31 PM |
| Tighten | 8 | 100000793693 | LCT | Flange | Dem | 96.6 | 110.5 | 0.0 | 21.6 | OK | 4/26/2010 | 5:43:36 PM |
| Inspect | 1 | 100000792549 | LCT | Flange | Dem | | 110.2 | | 21.8 | OK | 4/26/2010 | 5:43:37 PM |
| Inspect | 2 | 100000793418 | LCT | Flange | Dem | | 106.2 | | 21.9 | OK | 4/26/2010 | 5:43:38 PM |
| Inspect | 3 | 100000792648 | LCT | Flange | Dem | | 111.1 | | 21.8 | OK | 4/26/2010 | 5:43:39 PM |
| Inspect | 4 | 100000822369 | LCT | Flange | Dem | | 110.2 | | 21.8 | OK | 4/26/2010 | 5:43:40 PM |
| Inspect | 5 | 100000822402 | LCT | Flange | Dem | | 107.7 | | 21.9 | OK | 4/26/2010 | 5:43:41 PM |
| Inspect | 6 | 100000793429 | LCT | Flange | Dem | | 110.6 | | 21.8 | OK | 4/26/2010 | 5:43:42 PM |
| Inspect | 7 | 100000793264 | LCT | Flange | Dem | | 110.1 | | 21.9 | OK | 4/26/2010 | 5:43:42 PM |
| Inspect | 8 | 100000793693 | LCT | Flange | Dem | | 111.4 | | 21.9 | OK | 4/26/2010 | 5:43:43 PM |
| Inspect | 1 | 100000792549 | LCT | Flange | Dem | | 110.0 | | 21.9 | OK | 4/26/2010 | 5:43:44 PM |
| Inspect | 2 | 100000793418 | LCT | Flange | Dem | | 106.2 | | 21.9 | OK | 4/26/2010 | 5:43:45 PM |
| Inspect | 3 | 100000792648 | LCT | Flange | Dem | | 111.1 | | 21.8 | OK | 4/26/2010 | 5:43:46 PM |
| Inspect | 4 | 100000822369 | LCT | Flange | Dem | | 110.2 | | 21.8 | OK | 4/26/2010 | 5:43:47 PM |
| Inspect | 5 | 100000822402 | LCT | Flange | Dem | | 107.9 | | 21.8 | OK | 4/26/2010 | 5:43:47 PM |
| Inspect | 6 | 100000793429 | LCT | Flange | Dem | | 110.5 | | 21.8 | OK | 4/26/2010 | 5:43:48 PM |
| Inspect | 7 | 100000793264 | LCT | Flange | Dem | | 110.0 | | 21.9 | OK | 4/26/2010 | 5:43:49 PM |
| Inspect | 8 | 100000793693 | LCT | Flange | Dem | | 111.5 | | 21.9 | OK | 4/26/2010 | 5:43:50 PM |
| Inspect | 1 | 100000792549 | LCT | Flange | Dem | | 110.0 | | 21.9 | OK | 4/26/2010 | 5:43:51 PM |
| Inspect | 2 | 100000793418 | LCT | Flange | Dem | | 106.4 | | 21.8 | OK | 4/26/2010 | 5:43:52 PM |
| Inspect | 3 | 100000792648 | LCT | Flange | Dem | | 111.1 | | 21.8 | OK | 4/26/2010 | 5:43:52 PM |
| Inspect | 4 | 100000822369 | LCT | Flange | Dem | | 110.2 | | 21.8 | OK | 4/26/2010 | 5:43:53 PM |
| Inspect | 5 | 100000822402 | LCT | Flange | Dem | | 107.9 | | 21.8 | OK | 4/26/2010 | 5:43:54 PM |
| Inspect | 6 | 100000793429 | LCT | Flange | Dem | | 110.6 | | 21.8 | OK | 4/26/2010 | 5:43:55 PM |
| Inspect | 7 | 100000793264 | LCT | Flange | Dem | | 110.0 | | 21.9 | OK | 4/26/2010 | 5:43:56 PM |
| Inspect | 8 | 100000793693 | LCT | Flange | Dem | | 111.6 | | 21.9 | OK | 4/26/2010 | 5:43:57 PM |

SYSTEM FOR PERFORMING PREDEFINED FASTENER INSTALLATION PROCEDURES

BACKGROUND OF THE INVENTION

The present invention generally relates to the tightening of bolted joints, and more particularly, to the uniform and accurate tightening of bolted joints formed with multiple fasteners.

The joining of components in any of a variety of industries often requires the development of bolted joints for effectively securing the components to each other. This can include any of a variety of complex assembly procedures for properly securing a series of fasteners associated with an assembled component or combination of components. Examples of such procedures can include applications such as the joining of cylinder head assemblies to cylinder blocks, which is common practice in the automotive industry, the joining of pipe flanges, having applicability to any of a number of industries, and the complex assembly procedures that are prevalent in the aerospace industry, among others.

Irrespective of the application involved, the overall goal is to achieve a substantially uniform load in all of the fasteners associated with a particular bolted joint being produced, in order to provide a proper connection of components, while performing the required tightening sequence in the least amount of time possible. Although the problems in achieving such a result have been known for some time, numerous attempts at solving such problems have not been entirely successful.

As an example, and for applications involving the connection of flanged joints, U.S. Pat. No. 5,278,775 (Bibel) discloses a method for tightening the threaded fasteners associated with the flanged joint in an effort to achieve a substantially uniform load in all of the fasteners associated with that joint. The disclosed method attempts to solve problems noted in Bibel, G. D., "Tightening Groups of Fasteners in a Structure and the Resulting Elastic Interaction", Handbook of Bolts and Bolted Joints, Chapter 24, Marcel Dekker Inc. (1998), which recognizes that when a group of fasteners is tightened to form a joint, elongation of the individual fasteners causes structural interaction with the assembled joint which is being compressed, and that subsequent tightening further compresses the joint, reducing the preload in the previously tightened fasteners. Such effects are commonly referred to as "elastic interaction" or "bolt cross talk". Another effect to be taken into consideration, which is commonly referred to as "rocking", is where the load increases in a fastener diametrically opposite to the one being tightened. Such rocking can occur in a flange joint when the gasket outer diameter is smaller than the bolt circle diameter, which is often the case.

In an effort to accommodate such conditions, the method disclosed in U.S. Pat. No. 5,278,775 initially tightens each of the fasteners associated with the flanged joint system to a predetermined initial load or stress, in a first pass, and the final load, stress, strain or elongation is measured in each of the fasteners after all of the fasteners have been tightened. As used herein, a "pass" refers to a tightening procedure in which all of the fasteners for developing an assembled joint have been tightened once. Interaction coefficients representative of elastic interactions occurring between the fasteners in the system are thereafter calculated, and are used to predict an initial fastener strain value or load for each fastener in the system. These predicted values, together with the calculated interaction coefficients, are then used to tighten the threaded fasteners in a subsequent pass, whereupon the calculations and predictions are updated to achieve a desired tightening of the flanged joint.

Nevertheless, and even with load indicating fasteners such as the "I-Bolt®" fasteners which are available from Load Control Technologies of King of Prussia, Pa., it has not previously been possible to reliably achieve a satisfactory flange joint having substantially uniform stress on each of the fasteners without employing a significant number of passes in which each of the series of fasteners is sequentially tightened in a predefined pattern, resulting in a significant amount of time to produce the desired flange joint.

While the foregoing discusses problems associated with the joining of flanges, similar problems are presented in other complex assembly procedures. Moreover, such problems can further be complicated by the use of various different gasket materials for developing gasketed joints.

SUMMARY OF THE INVENTION

Such problems are solved in accordance with the present invention by establishing predefined procedures for performing a multi-step assembly of a desired joint using a dynamically controllable assembly tool. In joints such as flange joints, load indicating studs are used as the fasteners and access to both ends of each of the studs is made possible, and predefined procedures are established for performing a multi-step assembly in which there is simultaneous or parallel measurement of the load in all of the studs during the assembly operation. Other fasteners can be used to tighten other types of joints, using load indicating fasteners, or using conventional fasteners in which load, torque or other suitable measurements can be made to determine the degree to which such fasteners have been tightened, including fasteners which can only be accessed from one end. In any event, the operator is guided through a tightening sequence and the fastener target loads are modified based on the results of the measurements being made.

The preferred assembly tool includes a pneumatic tool coupled with an electronically controlled air pressure regulator for reducing the tightening rate, or the load increase per impact in the case of an impact or impulse tool, so that the tool can be stopped precisely at a specified stopping load or torque. The predefined procedures for performing the desired tightening operation are established in a controller coupled with the electronically controlled air pressure regulator, for dynamically controlling the pneumatic tool. As alternatives, electric or hydraulic tools can also be used.

The resulting system can then be used for the fast and accurate assembly of joints involving multiple fasteners and which are subject to elastic interaction between the fasteners, rocking, or joint relaxation.

The foregoing improvements are further described with reference to the detailed description which is provided hereafter, in conjunction with the following drawings.

BRIEF DESCRIPTION OF THE DRAWINGS

FIG. 8A is a portion of a table containing a sequence of predefined procedures for assembling a flange joint with a standard gasket.

FIG. 8B is a continuation of the table of FIG. 8A.

FIG. 8C is a continuation of the table of FIGS. 8A and 8B.

FIG. 9A is a portion of a table containing data resulting from a typical assembly following the sequence of predefined procedures for assembling the flange joint given in FIGS. 8A-8C.

FIG. 9B is a continuation of the table of FIG. 9A.

FIG. 9C is a continuation of the table of FIGS. 9A and 9B.

DETAILED DESCRIPTION OF PREFERRED EMBODIMENTS

Figures 1, 2:
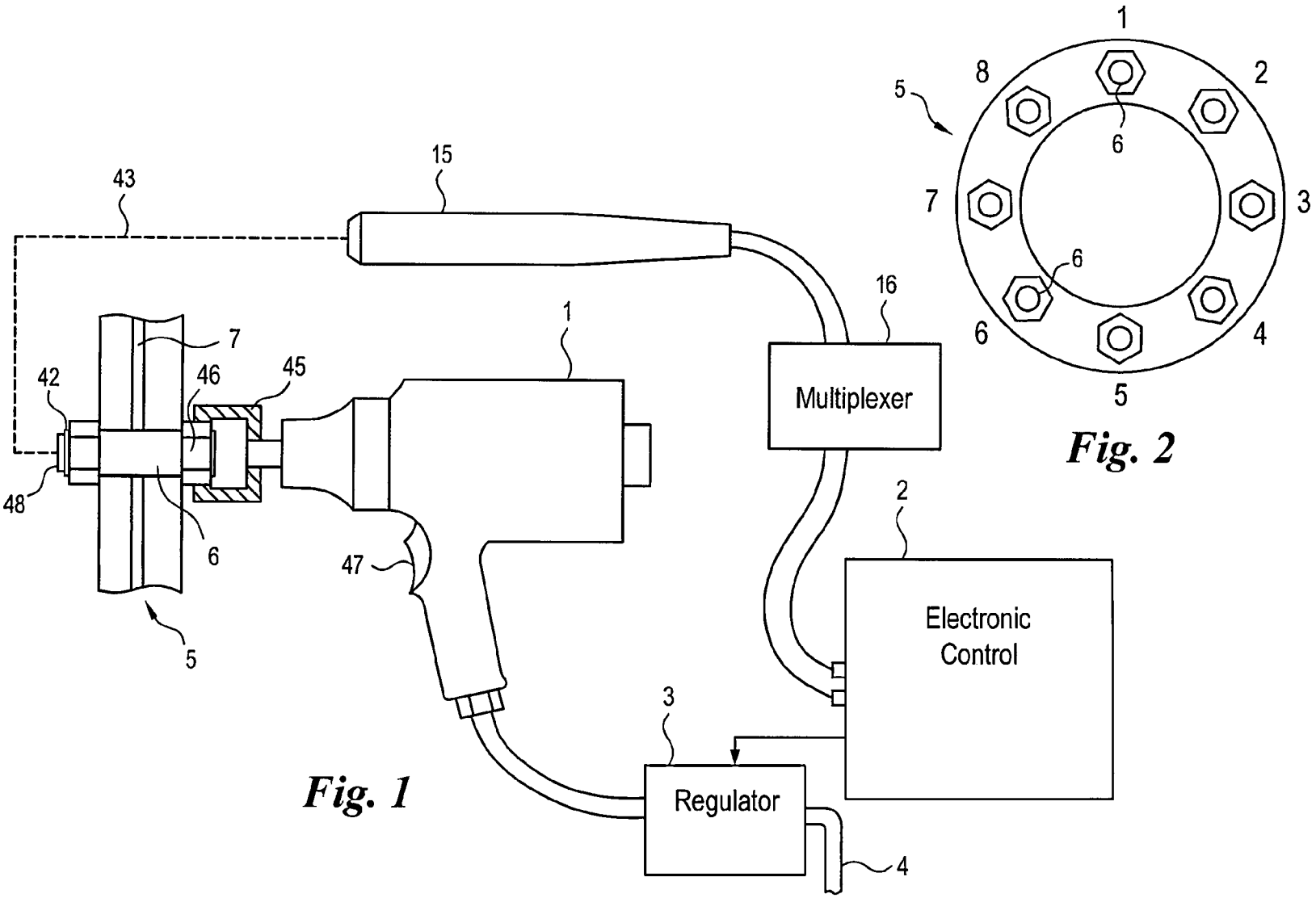
FIG. 1 is a schematic representation of a pneumatic tool in combination with a system for dynamically controlling the output power of the pneumatic tool during a fastener tightening cycle.
FIG. 2 is a schematic view of an illustrative flange joint.

FIG. 1 shows a preferred embodiment of the present invention which generally includes a pneumatic tool 1, an electronic control 2 for making load measurements in a fastener and for making control decisions based on the load measurements which have been made, and an electronically controlled air pressure regulator 3 associated with the supply line 4 which delivers pressurized air to the pneumatic tool 1 to dynamically control the air pressure supplied to the pneumatic tool 1 during tightening, and to stop the pneumatic tool 1 by reducing the supplied air pressure to zero, using techniques which are disclosed in U.S. Provisional Application No. 60/789,828, filed Apr. 6, 2006, and in an International Application filed Apr. 6, 2007, entitled "System for Dynamically Controlling the Torque Output of a Pneumatic Tool", the subject matter of which is incorporated by reference as if fully set forth herein. While the pneumatic tool 1 shown in FIG. 1 is an impact wrench which is operated responsive to load measurements in the fasteners, it is to be understood that other types of tools, which can be operated responsive to other measurements for determining the tightness of the fasteners, can similarly be used as desired.

Also schematically shown in FIGS. 1 and 2 is a flange joint 5 which is to be assembled using a plurality of fasteners 6. The flange joint 5 shown in FIG. 1 is a bolted flange joint of the type which is typically used to join sections of pipe, or to join a section of pipe with a desired vessel, and is separated by a gasket 7 which is appropriate for the particular assembly being performed. It is to be understood that the flange joint 5 has been shown only for purposes of illustration, and that the improvements of the present invention will find use with any of a number of joints to be assembled, examples including various applications in the aerospace and automotive industries, among others.

Similarly, the fasteners 6 shown in FIG. 1 are preferably implemented as load indicating fasteners with a permanent ultrasonic transducer, such as is described, for example, in U.S. Pat. No. 6,990,866; U.S. Pat. No. 5,220,839; U.S. Pat. No. 4,899,591; and U.S. Pat. No. 4,846,001, or as convention fasteners with removable ultrasonic transducers suitably applied to each of the fasteners. An identifying element (e.g., a bar code, an RFID device, a magnetic strip, etc.) is preferably associated with each ultrasonic transducer (whether permanently or removably attached to the fastener), for purposes of identifying each of the fasteners 6 as is described in U.S. Pat. No. 6,990,866, the subject matter of which is incorporated by reference as if fully set forth herein.

It is to be understood that any of a variety of different types of fasteners, combined with any of a variety of different types of fastener identifying elements, can be used in accordance with the present invention, other than the stud and nut combination which has been shown for illustrative purposes. For example, the fasteners can be implemented as studs or bolts, which can be combined with a backing nut, or which can engage a threaded body. The studs or bolts are preferably provided with an ultrasonic transducer 8 which is permanently coupled with an end of the fastener 6, and an identifying element 9 which is permanently coupled with exposed portions of the fastener 6, although removable components can also be used if desired. If removably coupled with the fastener 6, the ultrasonic transducer 8 can be adhered to, magnetically coupled with, frictionally coupled with, or screwed onto the fastener 6, including direct placement of the ultrasonic transducer on an end of the fastener 6 which is to receive it, by sliding the ultrasonic transducer over the end of the fastener 6 which is to receive it, or by screwing the ultrasonic transducer onto the fastener 6 which is to receive it. A temperature sensor can also be combined with a removable ultrasonic transducer, if desired.

Figure 3A:
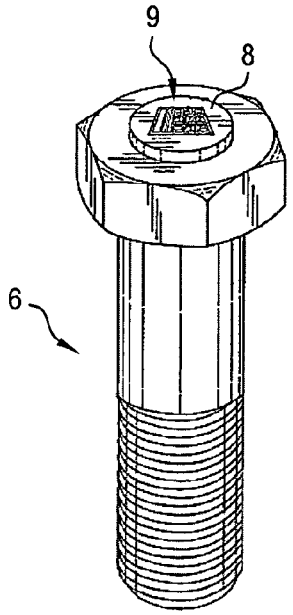
FIGS. 3A to 3J show various alternative embodiment fasteners.

FIG. 3A shows one such fastener, which is disclosed in U.S. Pat. No. 6,990,866, having an ultrasonic transducer 8 permanently coupled with the head of the fastener 6, and a bar code which serves as an identifying element 9 coupled with the ultrasonic transducer 8. The ultrasonic transducer 8 can also be coupled with the opposite end of the illustrated bolt (or stud), or an ultrasonic transducer can be coupled with both of the ends, if desired. For example, the exposure allowed to both ends of a stud can allow the use of one or more conventional ultrasonic transducers to monitor the tightening operation to be performed, from either end, and to log all of the operations being performed. The identifying element 9 can be coupled with the opposite end of the illustrated bolt (or stud), or with other portions of the head or body of the bolt (or stud). Multiple identifying elements 9 can be coupled with different portions of the bolt (or stud), for example, at each of the opposing ends, and can contain corresponding or complementary information, if desired.

Figure 3B:
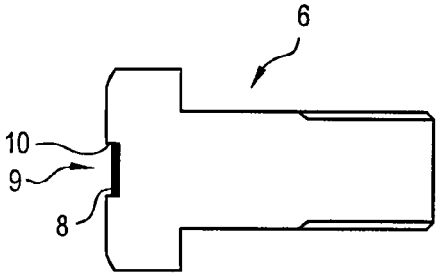
Figure 3C:
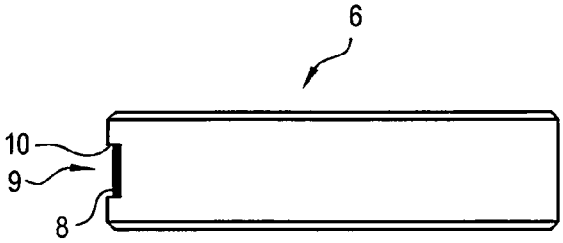
Figure 3D:
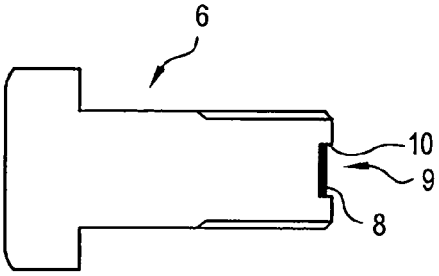
Figure 3E:
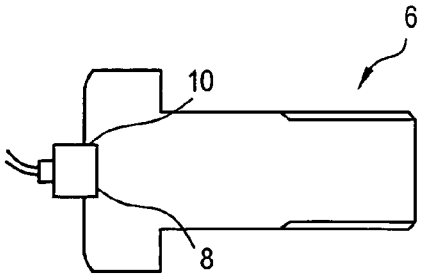
Figure 3F:
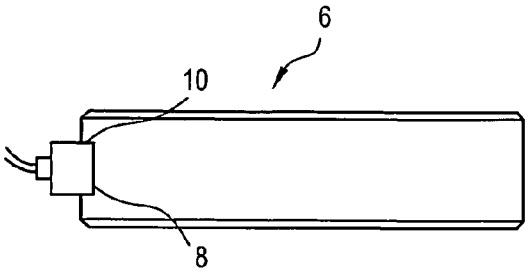
Figure 3G:
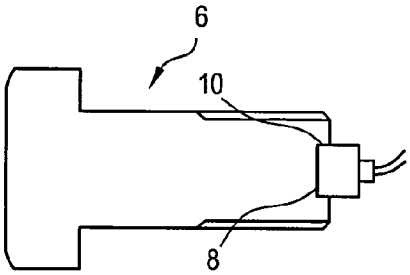
Figure 3H:
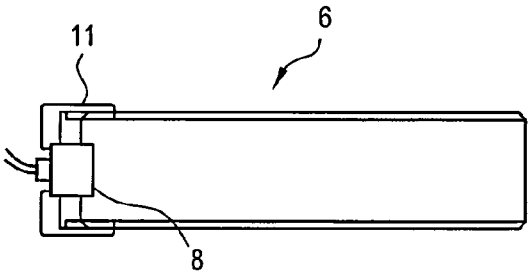
Figure 3I:
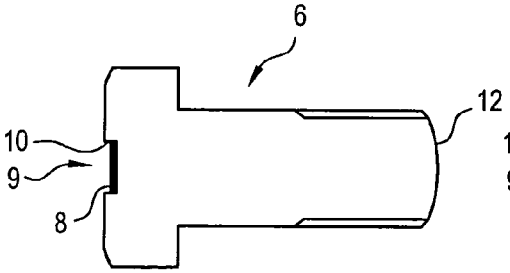
Figure 3J:
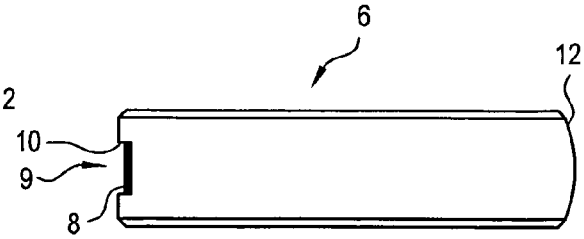

As further alternatives, the fasteners 6 can have a recess 10 in the head of the fastener (FIGS. 3B and 3C), as is disclosed in U.S. Pat. No. 5,131,276, or a recess in the opposite end of the fastener (FIG. 3D). The recess 10 can receive the ultrasonic transducer 8, as is shown in FIGS. 3E, 3F and 3G. For an ultrasonic transducer 8 which is removable, the recess 10 can be used to locate the ultrasonic transducer 8 so the ultrasonic transducer is positioned in the center of the end of the fastener 6 which receives it. A removable ultrasonic transducer 8 can also be centrally located, and additionally secured, with a locating nut 11, as is shown in FIG. 3H. One end of the fastener 6 can be provided with a convex curvature 12 (FIGS. 3I and 3J) to minimize the effects of bending, as is disclosed in U.S. Pat. No. 6,009,759. The subject matter of U.S. Pat. No. 6,009,759 and U.S. Pat. No. 5,131,276 is incorporated by reference as if fully set forth herein.

The fasteners 6 are suitably prepared to perform their intended function, which can vary and which will depend upon the combination of structural elements employed. To this end, one or more ends of a standard bolt (or stud) can be made suitable for electronic load measurement using techniques which are themselves known, and used in the industry for purposes of protecting bolts (or studs). For example, a coating compatible with ultrasonic load measurement can be applied to desired surfaces to protect against corrosion and exposure to environmental complications, including exposure to high temperatures. Suitable coatings for accomplishing this include metal plating, paints, polymer and epoxy coatings, and fluoropolymer corrosion coatings. The selected coating is preferably a non-sacrificial metal coating (e.g., chrome) to prevent the potential changes to parameters associated with the fastener which could otherwise result. The fasteners 6 are also pre-calibrated, i.e., pre-qualified and certified for integrity of the ultrasonic measurements to be performed, and appropriately identified, whether or not the fasteners 6 incorporate an ultrasonic transducer.

An identifying element such as a bar code, an RFID device, a magnetic strip, or some other suitable device, can be placed at one or both of the ends, or along the body of the fastener 6. As a further alternative, the identifying element can be coupled with the flange or other body which is to be subjected to a tightening procedure. For example, a label or strap can be applied to a surface of the flange, or other receiving body, either permanently, semi-permanently, or even removably, provided the applied identifying element is suitably prevented from rotating relative to the receiving structure. As an example, a stainless steel label can be used for this, which can further include a black oxide coating for marking purposes, if desired. The identifying element can have one or more bar codes associated with it, to identify any of a variety of parameters associated with the joint being produced, such as identification of the joint, the fasteners used to form the joint and/or parameters associated with the joint and the fasteners. The identifying element can also include a pointer for indicating a particular feature associated with the joint, such as the fastener which is to serve as the starting point for the tightening procedure which is to take place (e.g., to locate the first fastener in the sequence, with the remaining fasteners numbered in a clockwise sequence, resulting in an identification of all of the fasteners in the sequence). Such identification can complement, or serve as an alternative to any identifying elements provided on the fasteners associated with the joint. Multiple identifying elements can be useful in circumstances where damaging elements are present, so that a functioning identifying element remains available even where another identifying element has been compromised. The identifying element can further be provided with coded information in human-readable form, which can be manually entered by an operator in cases where the machine-readable identifying elements have all been compromised.

Figure 4:
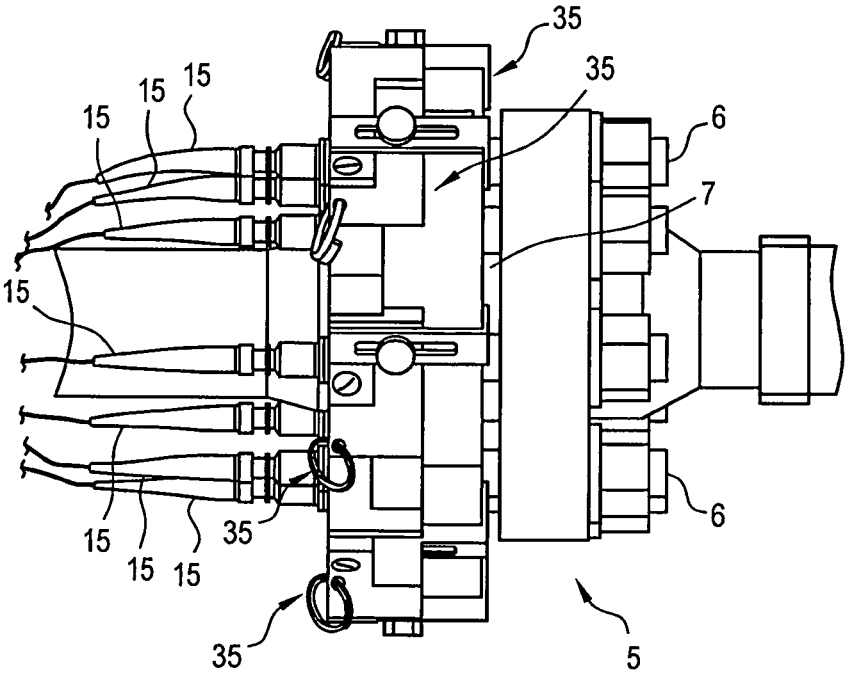
FIG. 4 shows the illustrative flange joint of FIG. 2 having separate probes coupled with each of the fasteners of the flange joint.

Referring to FIG. 1, a probe 15 is coupled with the electronic control 2 and, as is shown in FIG. 4, a separate probe 15 is preferably coupled with each of the fasteners 6 associated with the flange joint 5. Separate probes 15 are preferably provided to interface with each of the fasteners 6 to make load measurements in each of the fasteners 6, and to establish data pertaining to the fasteners 6 and associated with the procedure which is to take place, for purposes which will be discussed more fully below. A multiplexer 16 communicates with each of the probes 15 associated with the flange joint 5, and functions as a switch for selecting fasteners 6 for purposes of load measurement. The probes 15 are in this way electrically connected to the electronic control 2, which includes ultrasonic load measurement circuitry, as is described, for example, in U.S. Pat. No. 6,009,380, for purposes of making precise high speed ultrasonic load measurements in the fasteners 6 during tightening, for load control purposes, and for the subsequent inspection of tightened fasteners 6, as is described in U.S. Pat. No. 6,990,866. As an alternative, the electronic control 2 can include multiple load measurement modules, each of which is directly connected to one of the probes 15, eliminating the need for the multiplexer to perform simultaneous or parallel measurements from multiple fasteners.

The functions associated with the electronic control 2 can be performed using the "LoadMaster®" portable bolt load unit which is available from Load Control Technologies of King of Prussia, Pa. The functions associated with the fasteners 6 can be performed using "I-Bolt®" fasteners, which are also available from Load Control Technologies of King of Prussia, Pa. The functions associated with the probes 15 can be performed using the "LoadMaster® I-Probe" measurement, data logging and tracking device, which is also available from Load Control. Technologies of King of Prussia, Pa. An example of a system for performing different assembly procedures is given in Appendix 1, which is attached hereto and which is incorporated by reference as if fully set forth herein.

Operation of the system of the present invention will now be described with reference to the conventional high pressure 8-stud flange connection shown in FIG. 2 and in FIG. 4, and which is in and of itself commonly used in the oil and gas industry. However, it is to be understood that the 8-stud flange connection and the specific procedures which follow are given only for purposes of illustration, and that the system of the present invention can be used with any of a variety of flange connections, or other assembled joints, or to perform any of a variety of complex assembly procedures other than the specific assembly procedures which are to be described below, using the techniques which follow.

The electronic control 2, for example, the previously described "LoadMaster®" portable bolt load unit, incorporates a display 20 for purposes of supporting overall system operations, and for displaying data and other information associated with an assembly, identification and/or inspection procedure which is to take place. A typical example of such a display 20 is the screen shown in FIGS. 5 and 6, which is preferably implemented as a touch screen for facilitating the operations which follow.

Figure 5:
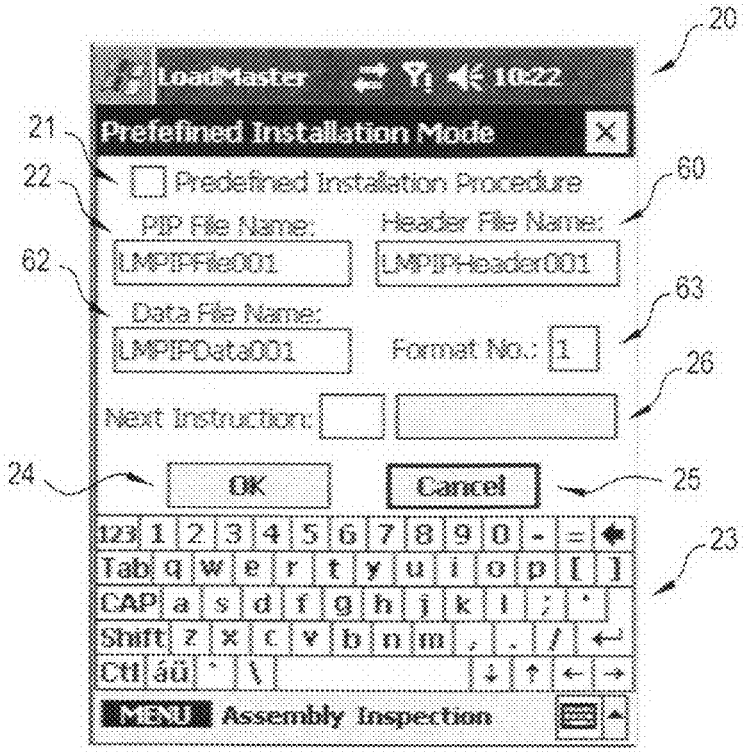
FIGS. 5 and 6 show displays for interacting with the system for dynamically controlling the output power of the pneumatic tool for implementing predefined procedures for performing a desired tightening operation.

The display 20 is accessed using techniques which are themselves known, in order to allow the system to automatically sequence through desired assembly or inspection operations. Such operations are preferably defined in an accessible program text file, an illustrative example of which is given in FIGS. 8A-8C. To this end, the instruction selection menu shown in FIG. 5 is brought up, which can be made openly accessible or limited to authorized personnel, as desired. Activation and deactivation of the operating system is accomplished using the on/off switch 21, and the user is then prompted, at 22 in FIG. 5, to enter a file name for a text file (filename.txt) which contains and defines the desired sequence of operating instructions to be performed. A keyboard 23 is provided for entering information into selected fields.

Examples of valid operating instructions which can be implemented by the accessed text file, for an illustrative sequence of bolts being operated upon to implement a selected tightening procedure, can include the following:

UnitsSelect: Always the first instruction, which reinitializes the instruction sequence and defines whether the numerical data is to be interpreted in US (klbs, lbf.ft, inch) or Metric (kN, Nm, mm) units.

CalCheck: Verifies calibration using a specified calibration bolt (bolt number must be entered as "0").

ScanBolt: An identification of the bolt will be read with a bar code reader (i.e., the probe 15) and assigned to bolt "n".

InspectBolt: Inspect bolt "n" according to defined parameters, including specification of a multiplexer channel.

TightenBolt: Tighten bolt "n" according to defined parameters, including specification of a multiplexer channel.

UntightenBolt: Untighten bolt "n" according to defined parameters.

ManualUntighten: Enable the pneumatic tool 1 for a manual untightening operation.

EndPIP: Always the last instruction, signaling an end to the selected procedure (referred to as a "PIP"). The operator receives confirmation that the selected procedure has been completed, and a data file giving results obtained during the procedure is transferred and/or copied to a backup location.

The "InspectBolt" and "TightenBolt" instructions have parameters for overriding a selected application number and application parameters including joint length, target load, minimum load, maximum load, minimum torque and maximum torque. Such instructions also provide for conditional "Operator Pause" and "GoTo" capabilities based on "OK", "NOK", or "Fault" status conditions following the selected operation. "Operator Pause" requires the operator to acknowledge an indicated status condition. The next instruction to be executed can be selected manually, if required, with an appropriate authorization.

Each text file contains a number of installation procedure instructions, which can be written in the following format. Each valid instruction preferably starts with an instruction number, followed by a separator (e.g., ":"), an instruction, and a number of operating parameters. Such fields are preferably separated by commas, and the final parameter is preferably terminated with a carriage return (i.e., <cr>). As an example, an illustrative instruction can be written as follows:

5:TightenBolt,7,Mode=5,AP=1,Load=11.0,MinLoad=9, MaxLoad=13,MinTorque=19,MaxTorque=39,JL=43, IfLO=P Call Supervisor,IfHI=P Call Supervisor<cr>

Such an instruction would be interpreted, and implemented by the electronic control 2, as:

Instruction 5: tighten bolt number 7 in Mode 5 using predefined application 1 and override load and joint length parameters, with a message to call the supervisor if the load is out of specification.

The following Table (Table 1) defines various instruction fields for writing an installation procedure:

TABLE 1

| Field No. | | Contents of Field |
|---|---|---|
| 1 | <n>: | where n is the instruction number and the ":" is the instruction prefix (a first instruction number "0:" is always preferably followed by a "UnitsSelect" instruction). |
| 2 | <instruction> | (as defined above). |
| 3 | <n> | where "n" is the bolt number, except for the "UnitsSelect" instruction, where field number 3 is either "Metric" or "US" (depending upon the units selected), and for "CalCheck", where "n" = 0. |
| Any | Mode = <n> | where "n" is the measurement mode (as will be described more fully below). |
| Any | AP = <n> | where "n" is an override application number. |
| Any | Part = <xxxxx> | where "xxxxx" are the first alphanumeric characters (up to 30) of a given part number, for confirmation of a correct part for scanning, or prior to the execution of an "Inspect" or "Tighten" instruction. |
| Any | JL = <n> | where "n" is an override joint length in the selected units (decimal points are allowed). |
| Any | Load = <n> | where "n" is an override target load in the selected units (decimal points are allowed). |
| Any | MinLoad = <n> | where "n" is an override minimum load in the selected units (decimal points are allowed). |
| Any | MaxLoad = <n> | where "n" is an override maximum load in the selected units (decimal points are allowed). |
| Any | TargetTorque = <n> | where "n" is an override target torque in the selected units (decimal points are allowed). |
| Any | MinTorque = <n> | where "n" is an override minimum torque in the selected units (decimal points are allowed). |
| Any | MaxTorque = <n> | where "n" is an override maximum torque in the selected units (decimal points are allowed). |
| Any | MinTime = <n> | where "n" is a minimum time (in minutes) after a timed instruction "TI" (which follows), before the present instruction is allowed to execute. |
| Any | TI = <n> | where "n" is an instruction number for the timed instruction. |
| Any | IfOK = <n> | If the achieved load is "OK", where "n" is the next instruction to execute, or "P" followed by a text operator message (30 characters maximum). |
| Any | IfLO = <n> | If the achieved load is "Low", where "n" is the next instruction to execute, or "P" followed by a text operator message (30 characters maximum). |
| Any | IfHI = <n> | If the achieved load is "High", where "n" is the next instruction to execute, or "P" followed by a text operator message (30 characters maximum). |
| Any | IfFault = <n> | If there is a measurement "Fault", where "n" is the next instruction to execute, or "P" followed by a text operator message (30 characters maximum). |
| Any | BoltCheck = <n> | A check is performed to verify that the number of bolts scanned is equal to "n" and that all of the bolt identification numbers are different (to verify that no bolt has been scanned more than once). |

The following Tables (Tables 2 to 4) define tightening modes for an installation procedure (for all multiplexer modes, the bolt number corresponds to the channel number):

TABLE 2

| "CalCheck Mode" | Calls for: |
|---|---|
| 0 | A standard calibration verification mode using a first numbered bolt (Cal Bolt 1). |
| 1 | A calibration verification mode that includes a confirmation of bolt identification, using a first numbered bolt (Cal Bolt 1). |
| 2 | A standard calibration verification mode using a second numbered bolt (Cal Bolt 2). |
| 3 | A calibration verification mode that includes a confirmation of bolt identification, using a second numbered bolt (Cal Bolt 2). |
| 4 | A calibration verification mode (Cal Bolt 1) through a first channel of the multiplexer (Channel 1). |
| 5 | A calibration verification mode that includes a confirmation of bolt identification (Cal Bolt 1) through a first channel of the multiplexer (Channel 1). |
| 6 | A calibration verification mode (Cal Bolt 2) through a first channel of the multiplexer (Channel 1). |
| 7 | A calibration verification mode that includes a confirmation of bolt identification (Cal Bolt 2) through a first channel of the multiplexer (Channel 1). |

TABLE 3

| "Inspection Mode" | Calls for: |
|---|---|
| 0 | A standard inspection mode. |
| 1 | An inspection mode that includes a confirmation of bolt identification. |
| 2 | An inspection mode through the multiplexer. |

TABLE 4

| "Assembly Modes" | Calls for: |
|---|---|
| 0 | A standard assembly mode, with a start switch. |
| 1 | An absolute assembly mode, with a start switch. |
| 2 | A standard power tool mode, without a start switch. |
| 3 | A standard power tool mode, with a start switch. |
| 4 | An absolute power tool mode, without a start switch. |
| 5 | An absolute power tool mode, with a start switch. |
| 10 | A standard assembly mode, with a start switch and a confirmation of bolt identification. |
| 11 | An absolute assembly mode, with a start switch and a confirmation of bolt identification. |
| 12 | A standard power tool mode, without a start switch and with a confirmation of bolt identification. |
| 13 | A standard power tool mode, with a start switch and a confirmation of bolt identification. |
| 14 | An absolute power tool mode, without a start switch and with a confirmation of bolt identification. |
| 15 | An absolute power tool mode, with a start switch and a confirmation of bolt identification. |

TABLE 4-continued

| "Assembly Modes" | Calls for: |
|---|---|
| 16 | A standard power tool mode, without a start switch and through the multiplexer. |
| 17 | A standard power tool mode, with a start switch and through the multiplexer. |
| 18 | An absolute power tool mode, without a start switch and through the multiplexer. |
| 19 | An absolute power tool mode, with a start switch and through the multiplexer. |
| 20 | A standard assembly mode, with a start switch and through the multiplexer. |
| 21 | An absolute assembly mode, with a start switch and through the multiplexer. |

In each case, the above-listed operating instructions, instruction fields and tightening modes are given as examples of presently preferred variables which can be used for implementing the operating system of the present invention. It is to be understood that other operating instructions, instruction fields and tightening modes can additionally be developed, if desired, to achieve other operating modes.

After entering a desired file name, calling a text file for implementing a desired sequence of operating instructions, the selected sequence of operating instructions is initiated, at 24 in FIG. 5. A "Cancel" function can also be selected, at 25, to allow any necessary corrections to be entered prior to the initiation of a called procedure.

Upon the initiation of a selected procedure, at 24, the user is prompted to take scheduled actions for accomplishing the selected operating procedure, at 26 in FIG. 5. Each prompt is preferably displayed as an instruction number followed by a separator (e.g., ":"), an instruction and the number of the bolt to be operated upon (e.g., 23: Tighten #7). Following completion of the instruction prompted at 26, the display 20 is changed to the display shown in FIG. 6, which includes a window 27 for indicating the number of the bolt which has been operated upon, a window 28 for indicating the load measured in the identified bolt, a window 29 for measuring the temperature of the flange joint 5 following completion of the prompted instruction, and a window 30 for displaying data produced in the course of following the instructions being performed responsive to displayed prompts. In a preferred embodiment, the electronic control 2 also has a voice output capability so that the above described operator instructions can be relayed wirelessly to the operator through wireless headphones, in this way eliminating the need for the operator to observe the display 20 during assembly.

Figure 7:
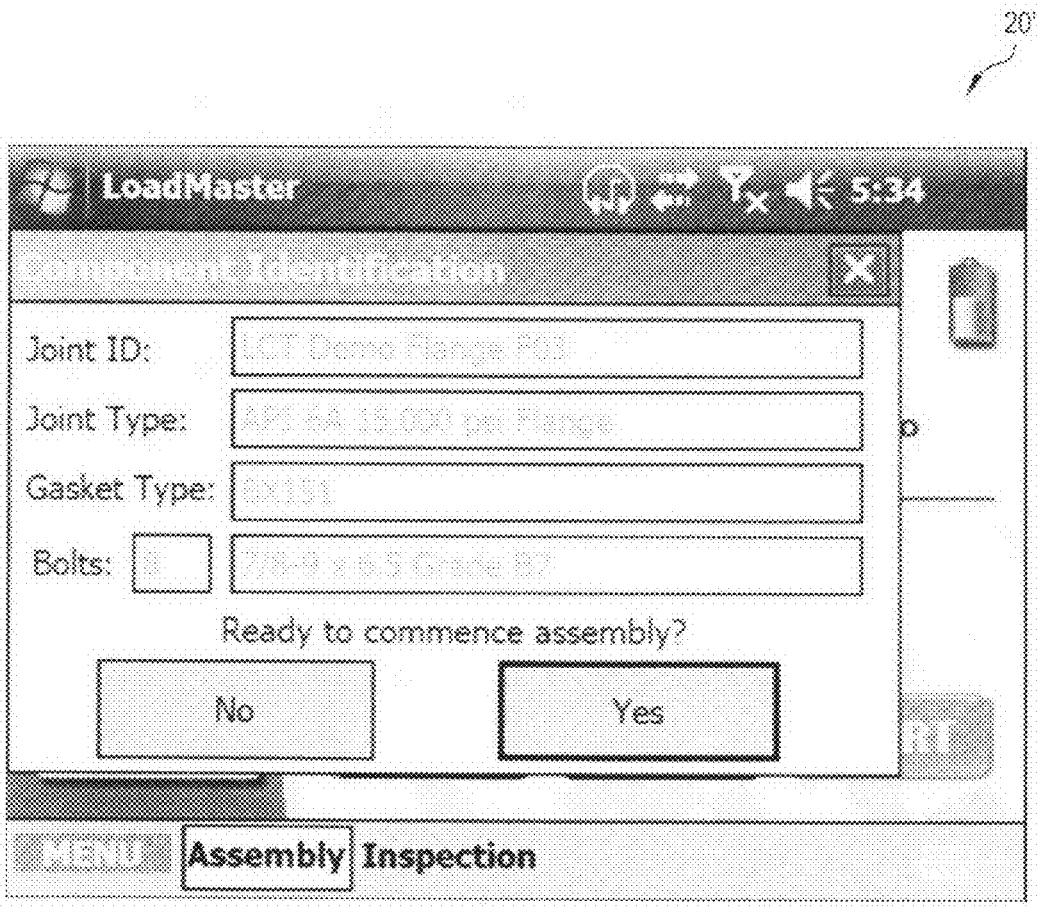
FIG. 7 shows a display of data retrieved for a typical flange joint.

The preferred embodiment of the present invention further includes the capability of reading an identification, such as a bar code, on the component to be assembled (e.g., a flange). From this reading, the electronic control 2 can retrieve all information relating to the assembly, eliminating the need for the operator to have knowledge of the specific component assembly procedure, and additionally automatically initiating the assembly procedure to be performed. Such information can include, for example, the identification of the component in the plant, for maintenance data logging of assembly operations, the correct fasteners and gasket to be used in the component, and the specified assembly procedure. An example of data retrieved for the 8-stud high pressure flange illustrated in FIGS. 2 and 4 is shown in FIG. 7.

FIG. 2 illustrates an assignment of numbers to the studs of the 8-stud flange which has been shown for illustrative purposes only. The numbers can be randomly assigned, and are preferably sequentially assigned, provided the same number is used to identify the same stud during the entire procedure being performed.

Figure 10:
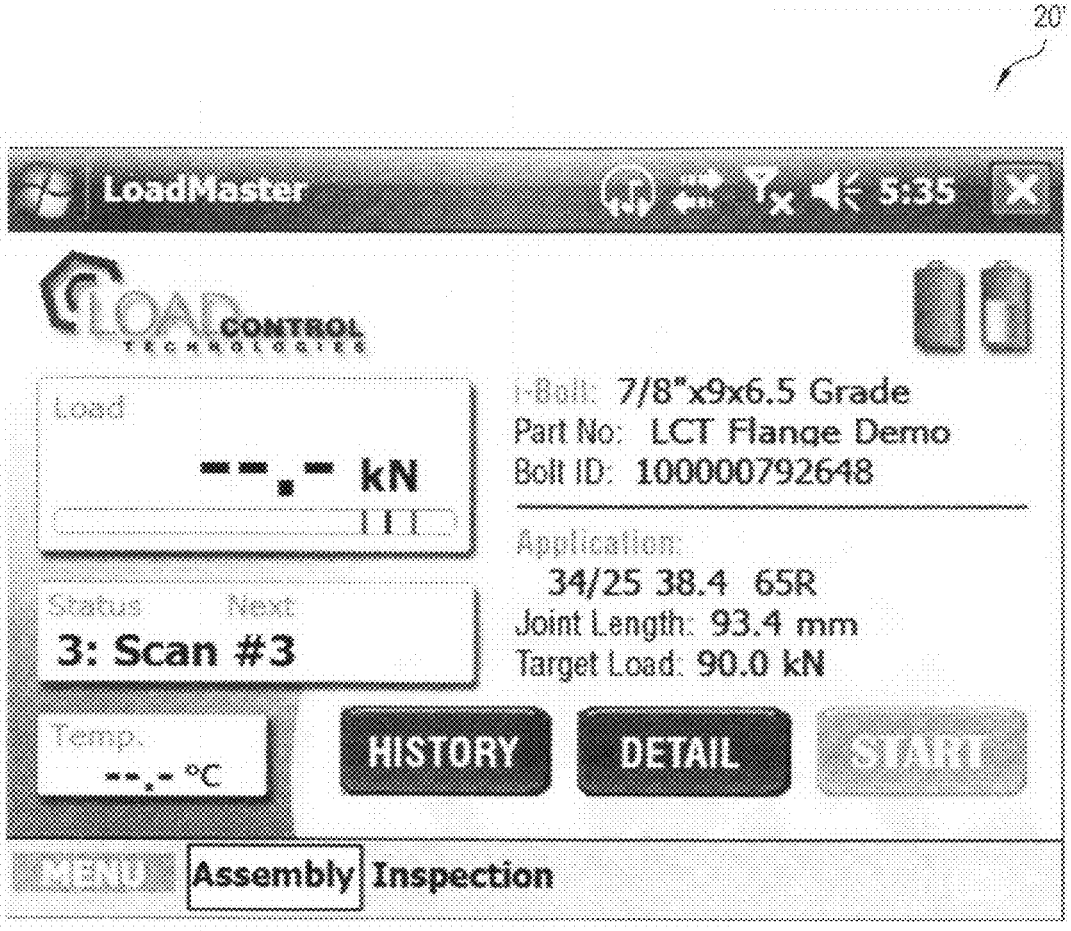
FIG. 10 shows a display of data following a scan of one of the fasteners of the flange joint.

As an example of the implementation of a selected tightening procedure, reference is made to FIGS. 8A-8C, which shows a sequence of predefined operations for assembling the 8-stud flange joint 5 shown in FIG. 4, and which is separated by a gasket 7. Responsive to prompts from the display 20 shown in FIG. 5, at 26, or by voice wirelessly through headphones, an operator would first be instructed to scan each of the studs 6 associated with the flange joint 5, in sequence. FIG. 10 shows an alternative embodiment for the display 20', which illustrates the results of a scan of one of the studs 6.

Following the numbers assigned to the studs 6, as previously described, steps are taken to apply devices on the nuts at the opposing ends of the studs to prevent the nuts from turning during tightening. Such devices are commonly referred to in the industry as "backup wrenches" or "torque reaction wrenches", examples of which are commercially available from Torcup of Easton, Pa. and A & W Devices of Brentwood, Calif. While such devices can be used with the present invention, they are in practice either cumbersome to use, and expensive, or lack a retaining feature to allow them to remain in place during the entire assembly process, especially when the flange pipe is vertical and such devices are required to secure the nuts on the underside of the flange. To accommodate this, the preferred embodiment of the present invention further uses an improved backup wrench, which is described below, which is simple and inexpensive to manufacture, and which includes a combined retaining and torque release mechanism for easy mounting and removal.

Figure 11:
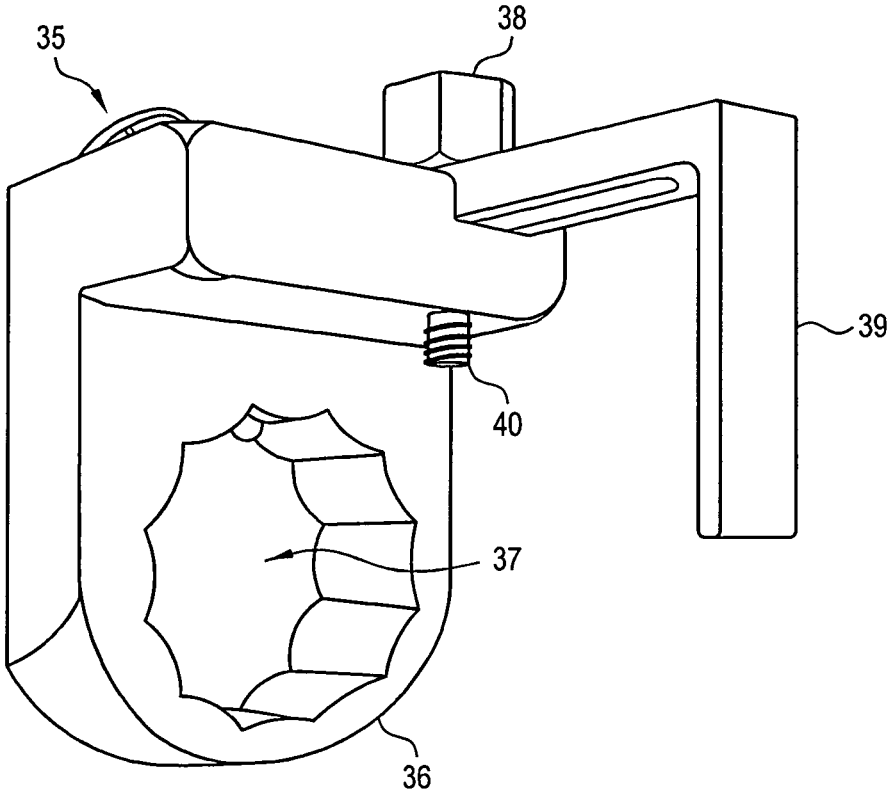
FIGS. 11 and 12 show an improved backup wrench assembly.
Figure 12:
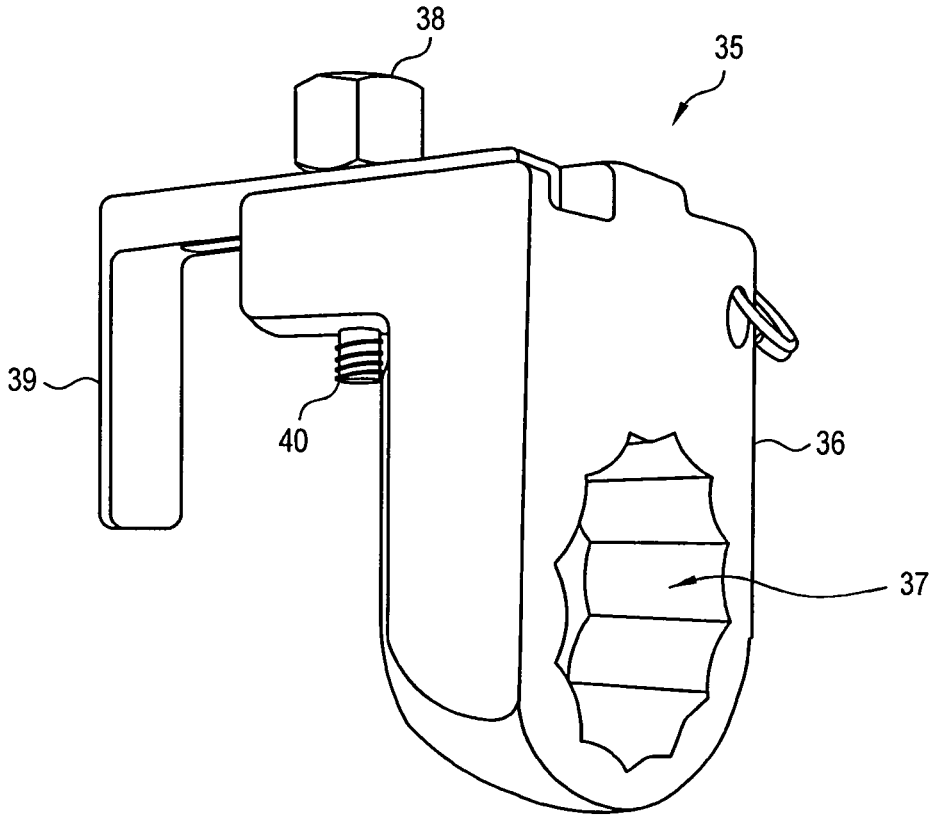

FIGS. 11 and 12 show a preferred embodiment of the backup wrench assembly 35. A wrench body 36 is provided which conventionally includes a hole 37 having a socket profile for engaging a nut to prevent rotation. A screw 38 is provided for securing a retaining bracket 39 to the wrench body 36 which is capable of being positioned over an outer edge of the flange. The screw 38 is then tightened by hand to prevent the backup wrench 35 from falling off during the assembly process. Since the threaded end 40 of the screw 38 protrudes through the body 36, when the engaged nut rotates as a result of tightening torque being applied to the stud, the backup wrench 35 will rotate until prevented from further rotation by the protruding end 40 of the screw 38, which will then engage the outer edge of the flange. Upon completion of the assembly process, the backup wrench 35 is easily removed, for example, by untightening the screw 38 to remove any residual reaction torque and release the retaining bracket 39.

Figure 13:
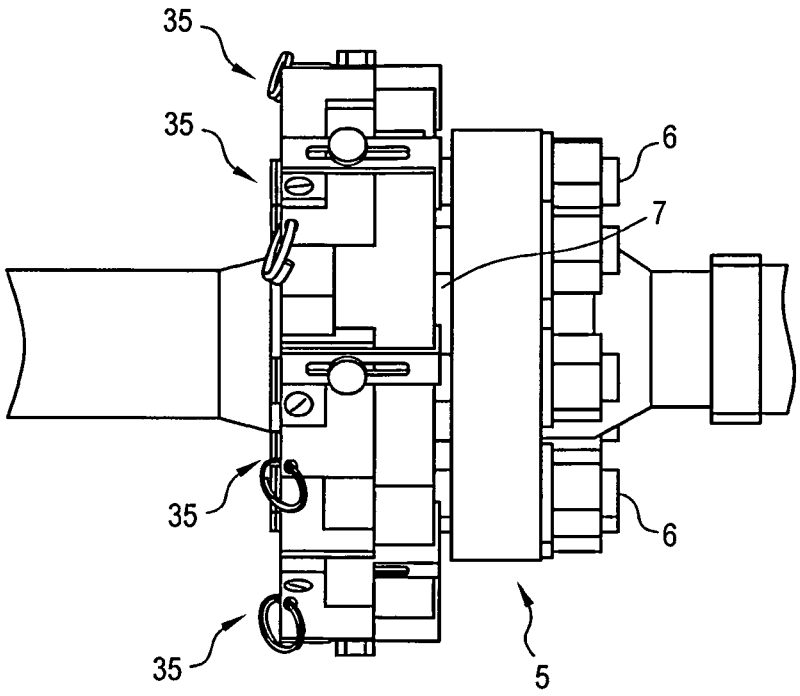
FIG. 13 illustrates a plurality of the backup wrench assemblies shown in FIGS. 11 and 12 in combination with the flange joint shown in FIG. 4.
Figure 14:
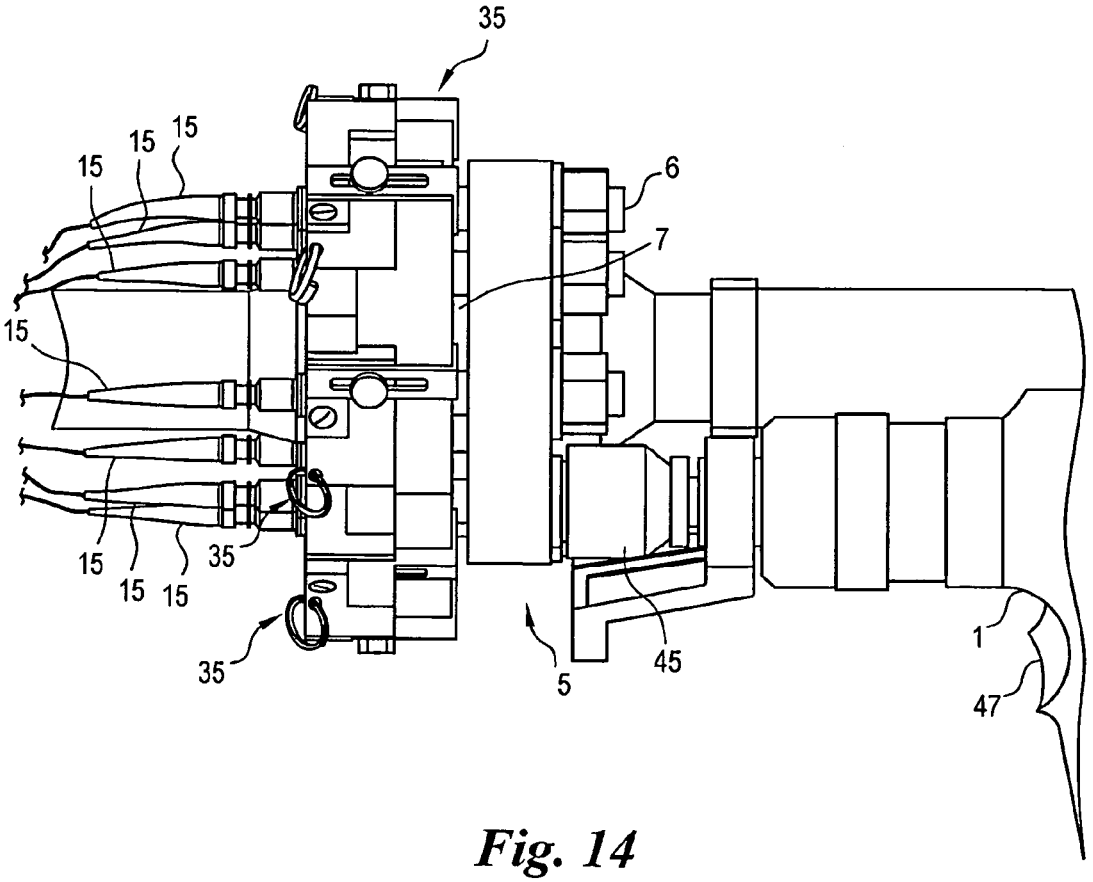
FIG. 14 shows an illustrative fastener tightening procedure for the flange joint shown in FIG. 4.

After the backup wrench 35 has been mounted on the nut of each of the studs (FIG. 13), at the end of the stud with the ultrasonic transducer and opposite to the end of the stud to be tightened, steps are taken to apply a probe 15 to the end 42 of each of the studs 6 (which is schematically shown at 43 in FIG. 1). The probes 15 are preferably magnetic to allow them to be easily applied to the ends of the studs 6. Following application of the probes 15 to each of the studs 6 associated with the flange joint 5, the operator would then be instructed to tighten each of the studs 6 associated with the flange joint 5, in an assigned (predefined) sequence. As before, the procedure to be performed will be prompted, at 26, or by voice, wirelessly through operator headphones. The tool 45 associated with the pneumatic tool 1 is then engaged with the backing nut 46 associated with the stud 6, as is shown in FIGS. 1 and 14, and the trigger 47 of the pneumatic tool 1 is engaged to activate the pneumatic tool 1.

Figure 15:
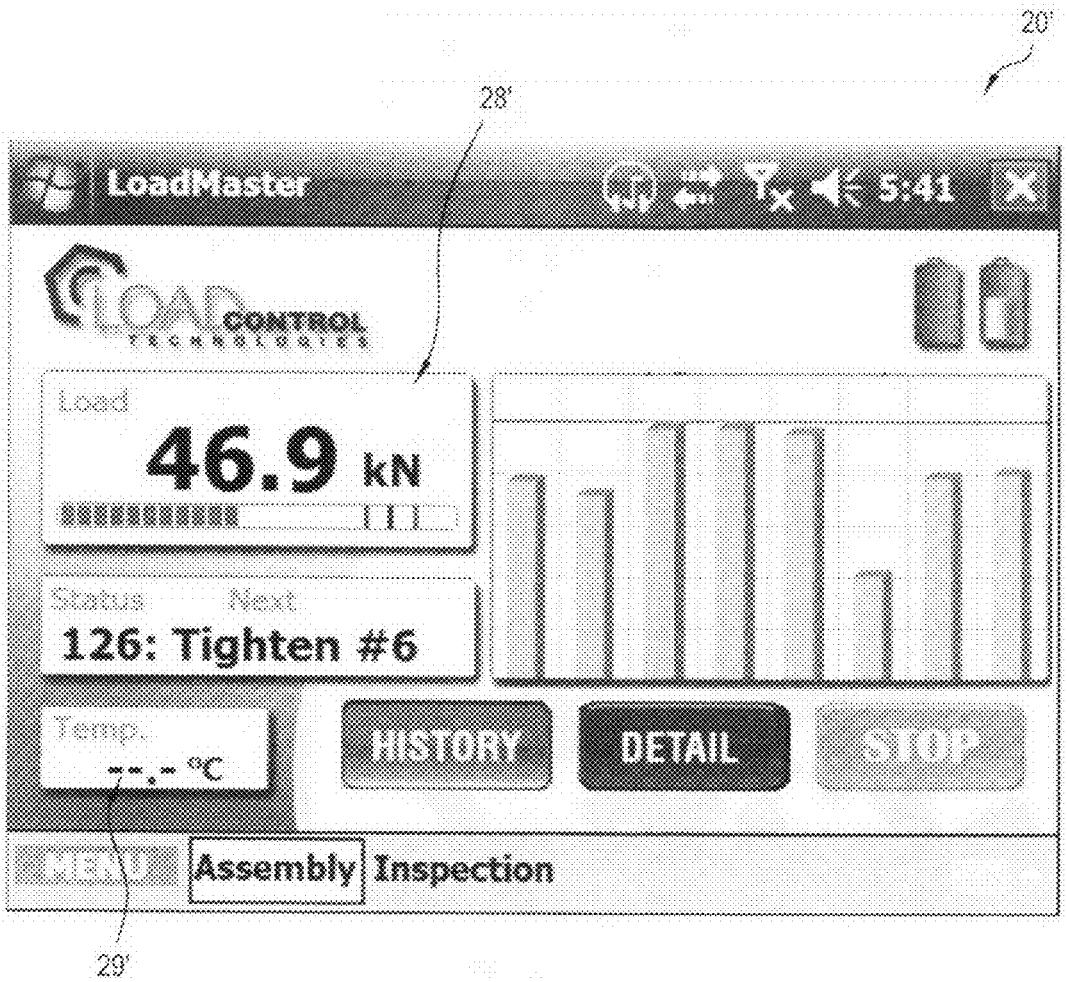
FIGS. 15 and 16 show examples of screen displays showing the load remaining in each of the fasteners after tightening and gasket relaxation.
Figure 16:
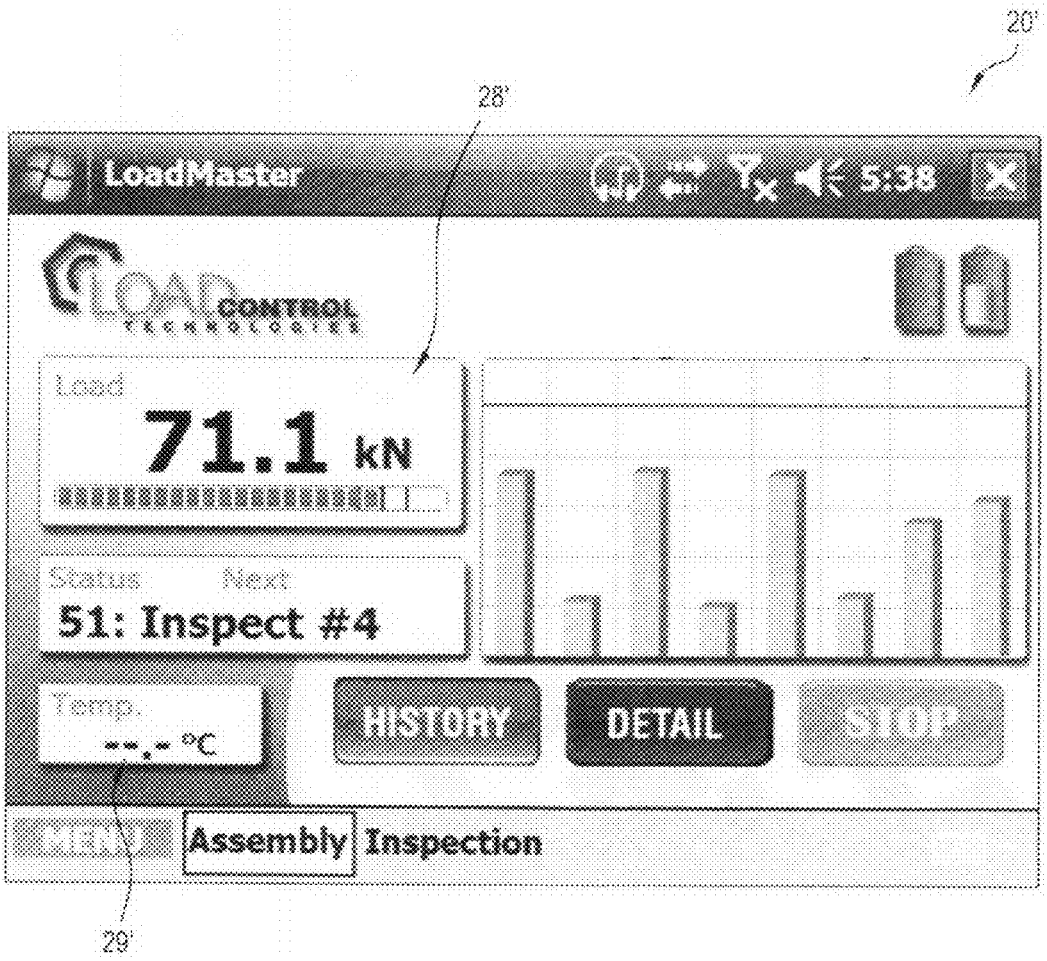

Prior to issuing a prompt to an operator, electronic control 2 first switches the multiplexer 16 to read the next stud in the sequence to be tightened. If the load in the stud is already at the target load for the stud for the current pass, tightening of that stud is skipped, eliminating the need for the tightening prompt and the associated tightening operation. The assembly process then continues until the pass is completed, i.e., all studs have been tightened once, if required. In the preferred embodiment, and after each pass, electronic control 2 measures and stores the load in each stud by sequentially selecting the stud for measurement using the multiplexer 16. During this operation, the display 20 is updated to show the remaining load in each stud after the affect of elastic interaction or rocking from subsequent bolt tightening and gasket relaxation (examples of this are shown in FIGS. 15 and 16). The flange assembly then continues, with additional passes to predefined loads, until all of the studs are at their final specified loads, at which time the assembly procedure is complete. The results of the assembly operation of each stud in the identified flange are automatically logged by electronic control 2 for transfer to a maintenance database.

In the above-described embodiment, the sequence and the loads for each pass are predefined in the programmable installation procedure. It will be appreciated by one skilled in the art that the measurement of loads in all studs after each pass provides the necessary information to determine the elastic interaction, rocking, or other effects of the tightening of each stud on the load of every other stud in the joint, as is described in the above-referenced disclosure of Bibel, G. D., "Tightening Groups of Fasteners in a Structure and the Resulting Elastic Interaction", Handbook of Bolts and Bolted Joints, Chapter 24, Marcel Dekker Inc. (1998), the subject matter of which is incorporated by reference as if fully set forth herein. Consequently, the electronic control 2 has the data and capability to calculate this interaction after a pass and adjust the target loads for each stud for subsequent passes in order to optimize the assembly procedure to precisely obtain the final load with a minimum of tightening operations.

Using the techniques disclosed in U.S. Provisional Application No. 60/789,828 and the corresponding International Application, in each of the above-described assembly operations, the pneumatic tool 1 operates to tighten the nut 46 on the stud 6 until a target load specified for the stud 6 (specified in the operating instruction written in the text file) has been reached. The pneumatic tool 1 is automatically stopped when the specified target load is reached, which is monitored through the multiplexer 16 using the probe 15, in conjunction with the ultrasonic transducer 48. The achieved load is displayed for the operator in the window 28 shown in FIG. 6, or in the window 28' of the alternative embodiment display 20' shown in FIGS. 15 and 16. With absolute ultrasonic load measurements, it is necessary to measure the temperature of the fastener and to compensate for errors from thermal effects. The temperature of the flange joint 5 is monitored as part of the procedures for automatically controlling the pneumatic tool 1, as previously described, and is displayed for the operator in the window 29 shown in FIG. 6, or in the window 29' shown in the alternative embodiment display 20' shown in FIGS. 15 and 16. Each probe 15 preferably further includes its own temperature transducer so that the load measurement for each stud can be compensated with that stud's individual temperature measurement.

In the above-described assembly procedure, there remains a risk that the operator will place the tightening tool on the wrong stud and commence assembly while electronic control 2 is monitoring the specified stud. In order to prevent tightening of the wrong stud, electronic control 2 has the ability to detect when the tool is being operated. For a tool with an electrical start switch, this can be done simply by monitoring the state of the switch. For an air tool without an electrical start switch, this is done with a flow switch in the air line. For an electric tool, this is done by monitoring motor current. Should the tool be operated without a corresponding increase in the monitored load, electronic control 2 will immediately shut off the tool, indicating a fault condition.

FIGS. 9A-9C show a typical data file for the sequence of predefined procedures listed in FIGS. 8A-8C. The illustrative data file 50 includes an indication of the instruction being performed (shown at 51), an identification of the bolt being operated upon (shown at 52), the achieved load (shown at 53), whether the achieved load is in its desired range (shown at 54), and the date and time each step was performed (shown at 55 and 56). It is to be understood that the data file can include other data fields, and other combinations of data fields, if desired.

Any of a number of text files containing any of a variety of instruction sets can be developed for achieving desired complex assembly procedures. This can include complex assembly procedures of the type described above, as well as complex assembly procedures developed for other applications. The various instructions to be implemented, and the manner in which such instructions are combined, can be developed through calculations or empirically, and can be further optimized by the adjustment of developed instructions resulting from experimental activity.

As an example, the instruction set shown in FIGS. 8A-8C can be developed empirically, or through calculations based on the above-referenced teachings of Bibel, G. D., "Tightening Groups of Fasteners in a Structure and the Resulting Elastic Interaction", Handbook of Bolts and Bolted Joints, Chapter 24, Marcel Dekker Inc. (1998), the subject matter of which is incorporated by reference as if fully set forth herein. Once developed, the instructions can be further optimized responsive to experimentation using the developed instructions, or in the course of performing actual operations, followed by suitable adjustment of the developed instruction set (again, empirically, or through calculations). The developed instructions are then stored in memory, as previously described, for selective access responsive to operations of the display 20 associated with the electronic control 2, for example. Any number of text files can be stored in this fashion, limited only by available memory, allowing a variety of complex assembly procedures to be accomplished with a single system.

The display 20 can also be used to display various functions associated with the accessed text file, and the instructions implemented responsive to the accessed text file.

For example, a user can be prompted, at 60 in FIG. 5, to enter a header file name (filename.txt) which contains information pertinent to the operations to be performed responsive to the accessed text file (using, for example, the keyboard 23). The header file name is used to gain access to a header file associated with the data files produced responsive to operations of the accessed text file. As an example, the data file shown in FIGS. 9A-9C has a header 61 which contains information for identifying the operator performing the procedure, characteristics of the components being operated upon, information for identifying the procedure, and time and date information. It is to be understood that other information relating to other operations involving different complex assembly procedures can similarly be entered into desired header formats pertinent to the operations to be performed.

Similarly, if data is to be output to a data file, the user can be prompted to enter a data file name (filename.txt), at 62 in FIG. 5, and a data format number, at 63 in FIG. 5, to identify the data file being produced and to establish the format for the data file (using, for example, the keyboard 23). The data format number can be used to determine the format and the content of the header 61, and to define output format parameters such as the number of columns and rows to be displayed, among others. Text data file formats are preferably predefined, and are preferably selectable by format number. If a valid header file exists, the header data is preferably written at the start of the data file and within a data report if changed during execution of the instructions contained in the accessed text file.

While the foregoing improvements have been described based on certain specific embodiments, incorporating specified components and applied methods, it will be understood that such improvements can equally be employed in any of a variety of alternative applications, having applicability to any of a variety of industries, such as the petrochemical industry, including subsea applications, and the automotive and aerospace industries, referred to previously, or to other industries, including the nuclear and wind power industries.

This can include applications involving both simple and complex joints, employing assembly technologies from uncontrolled tools with low grade bolts to the precision assembly of critical joints with fasteners incorporating load measurement technologies such as those which have previously been described. The quality of the assembly can in any event be improved by significantly reducing operator related assembly errors for all joints through procedure guiding, monitoring and validation of correct assembly operations. This can in each case be accomplished by guiding an operator through an entire predefined assembly procedure, or selected portions of an assembly procedure, through displayed operator instructions or by voice commands, reducing dependency on operator knowledge or judgments, and applying multiple checks to ensure that procedures are followed.

Such improvements are capable of facilitating any of a variety of assembly control or data management requirements, including the monitoring or controlling of torque, hydraulic pressure, electric motor current, drop in air motor speed or angle, or other similar applications, using any of a variety of electronically controllable units suitable to the assembly tool being used and controlled, as well as the parameters being monitored, and are applicable to identification, tracking, assembly procedure guidance, assembly procedure validation and data logging technology in conjunction with any of a variety of fasteners, assembly tools and methods.

It is even possible for such improvements to be used with standard fasteners, without any fastener identification, or responsive only to measurements of torque, without ultrasonic load measurement, using any of a variety of tightening tools, including hydraulic, pneumatic and electric tools, and any of a variety of electronically controllable units, appropriately modified to interface with the previously described components. As an example, hydraulically operated tools, such as hydraulic ratchet tools, can be controlled using known hydraulic pressure transducers in place of the previously described air pressure regulator.

As a further alternative, conventional, removable ultrasonic technology can be used in applications where the use of permanent ultrasonic technology is impractical, for example, in applications where the cost of permanent ultrasonic technology is not justified and the assembly time is not critical, in applications involving the use of very large fasteners, where it is not practical to ship the fasteners for transducer attachment, in high temperature applications where subsequent inspection is required, and in extreme corrosive environments where subsequent inspection is required. The fasteners used in such applications, however, are preferably pre-calibrated, certified fasteners to maximize the results obtainable in such applications.

It will therefore be understood that the present invention further encompasses all enabled equivalents of the components and methods described, and that various changes in the details, materials and arrangement of parts which have been herein described and illustrated in order to explain the nature of this invention may be made by those skilled in the art within the principle and scope of the invention as expressed in the following claims.

APPENDIX 1

LoadMaster Predefined Installation Procedure (PIP) Mode

General Description:

The LoadMaster Predefined Installation Procedure (PIP) allows the LoadMaster to automatically sequence through assembly or inspection operations defined in a simple program text file. To select this mode go to Menu\Operation\Predefined Installation Proc. (Must have Customer Access Level for this selection; see section 5.0 of the LoadMaster Quick Start Guide).

Upon selection of the Predefined Installation Procedure (PIP) Mode on the LoadMaster, the user is asked to enter the PIP file name (filename.txt). If data is to be output to a data txt file, the data file name, data format number and header file name are also entered.

The unique id of the calibration bolt to be used must be input under Menu\Calibration and checked as default.

To run the LoadMaster on PIP mode directly from the storage card please see section 6.3 of the LoadMaster Quick Start Guide.

NOTE: The "Backup" folder in the storage card under "My Documents" will always contain the cumulative data txt file. The data txt file under directly under "My Documents" only will have the latest set of measurements.

The following are valid PIP instructions:

UnitsSelect Always the first instruction which reinitializes the PIP instruction sequence and defines whether the numerical data is to be interpreted in US (klbs, lbf.ft, inch) or Metric (kN, Nm, mm) units.

CalCheck Verify calibration using the specified calibration bolt. (Bolt No. must be entered as "0".)

ScanBolt A Bolt ID will be read with the bar code reader and assigned to Bolt "n"

InspectBolt Inspect Bolt "n" according to defined parameters

TightenBolt Tighten Bolt "n" according to defined parameters

UntightenBolt Untighten Bolt "n" according to defined parameters

ManualUntighten Enable tool for a manual untightening operation

EndPIP Always the last instruction. Operator confirmation. Data file is transferred and/or copied to backup location.

InspectBolt and TightenBolt instructions have parameters to override selected application number and application parameters including joint length, target load, min. load, max. load, min torque and max. torque. They also provide for conditional Operator Pause and GoTo based on OK, NOK, or Fault status following the operation. Operator Pause requires operator acknowledgment of a status. The next PIP instruction to be executed can be selected manually if required with the appropriate authorization.

Text data file formats are predefined and selected by format number. If a valid header file exists, the header data is written at the start of the data file and within the data report if changed during PIP execution.

PIP Text File Instruction Format

A PIP File is a text file containing a number of LoadMaster installation procedure instructions. Each valid instruction starts with the instruction number, ":", instruction, and a number of parameters separated by commas with the final parameter terminated with a <cr>, e.g., 5:TightenBolt,7,Mode=5,AP=1,Load=11.0,MinLoad=9, MaxLoad=13,MinTorque=19, MaxTorque=39,JL=43, IfLO=P Call Supervisor, IfHI=P Call Supervisor<cr> which is interpreted by the LoadMaster as: Instruction 5, tighten bolt no. 7 in Mode 5 using predefined application 1, override load and joint length parameters, with a message to call the supervisor if the load is out of spec.

DEFINITION OF INSTALLATION PROCEDURE INSTRUCTION FIELDS

| Field No. | | Contents of Field |
|---|---|---|
| 1 | <n>: | where n is the instruction number and the ":" is the instruction prefix. (The first instruction number 0: is always followed by the UnitsSelect instruction.) |
| 2 | <instruction> | (as defined above) |
| 3 | <n> | where "n" is the bolt number (except for the UnitsSelect instruction where field 3 is either "Metric" or "US"). For CalCheck, "n" = 0. |
| Any | Mode = <n> | where "n" is the measurement mode (see below) |
| Any | AP = <n> | where "n" is the override application number |
| Any | Part = <xxxxx> | where "xxxx" is the first alphanumeric characters up to 30) of the customers part no. for confirmation of a correct part for a scan, or prior to the execution of an inspect or tighten instruction |
| Any | JL = <n> | where "n" is the override joint length in the selected units (decimal point allowed) |
| Any | Load = <n> | where "n" is the override target load in the selected units (decimal point allowed) |
| Any | MinLoad = <n> | where "n" is the override minimum load in the selected units (decimal point allowed) |
| Any | MaxLoad = <n> | where "n" is the override maximum load in the selected units (decimal point allowed) |
| Any | TargetTorque = <n> | where "n" is the override target torque in the selected units (decimal point allowed) |
| Any | MinTorque = <n> | where "n" is the override minimum torque in the selected units (decimal point allowed) |
| Any | MaxTorque = <n> | where "n" is the override maximum torque in the selected units (decimal point allowed) |
| Any | MinTime = <n> | where "n" is the minimum time in minutes after the Timed Instruction "TI" before this instruction is allowed to execute |
| Any | TI = <n> | where "n" is the instruction number for the timed timed instruction |
| Any | IfOK = <n> | If load is OK, where "n" is the next instruction to execute, or "P" followed by a text operator message (30 characters max.) |
| Any | IfLO = <n> | If load is Low, where "n" is the next instruction to execute, or "P" followed by a text operator message (30 characters max.) |
| Any | IfHI = <n> | If load is High, where "n" is the next instruction to execute, or "P" followed by a text operator message (30 characters max.) |

-continued

| Field No. | | Contents of Field |
|---|---|---|
| Any | IfFault = <n> | If there is a measurement Fault, where "n" is the next instruction to execute, or "P" followed by a text operator message (30 characters max.) |
| Any | BoltCheck = <n> | Checks that the no. of bolts scanned is equal to "n" and that all BoltID's are different (i.e. no bolt has been scanned more than once) |

Tightening Modes

CalCheck Mode

0 Standard Calibration Verification Mode using Cal Bolt 1

1 Calibration Verification Mode with bolt confirmation using Cal Bolt 1

2 Standard Calibration Verification Mode using Cal Bolt 2

3 Calibration Verification Mode with bolt confirmation using Cal Bolt 2

4 Calibration Verification Mode, Cal Bolt 1, thru' multiplexer channel 1

5 Calibration Verification Mode, bolt confirm, Cal Bolt 1, multiplexer ch. 1

6 Calibration Verification Mode, Cal Bolt 2, thru' multiplexer channel 1

7 Calibration Verification Mode, bolt confirm, Cal Bolt 2, multiplexer ch. 1

Inspection Mode

0 Standard Inspection Mode

1 Inspection Mode with bolt confirmation

2 Inspection Mode thru' multiplexer (bolt no.=channel no.)

Assembly Modes

0 Standard Assembly Mode with start switch

1 Absolute Assembly Mode with start switch

2 Standard Power Tool Mode without start switch

3 Standard Power Tool Mode with start switch

4 Absolute Power Tool Mode without start switch

5 Absolute Power Tool Mode with start switch

10 Standard Assembly Mode with start switch (bolt ID confirmation)

11 Absolute Assembly Mode with start switch (bolt ID confirmation)

12 Standard Power Tool Mode without start switch (bolt ID confirmation)

13 Standard Power Tool Mode with start switch (bolt ID confirmation)

14 Absolute Power Tool Mode without start switch (bolt ID confirmation)

15 Absolute Power Tool Mode with start switch (bolt ID confirmation)

16 Standard Power Tool Mode without start switch thru' multiplexer

17 Standard Power Tool Mode with start switch thru' multiplexer

18 Absolute Power Tool Mode without start switch thru' multiplexer

19 Absolute Power Tool Mode with start switch thru' multiplexer

20 Standard Assembly Mode with start switch thru' multiplexer

21 Absolute Assembly Mode with start switch thru' multiplexer

Note: For all multiplexer modes, bolt no.=channel no.

PIP Mode Selection Menu

PIP Mode: on/off

PIP File Name: filename (.txt)

Data File Name: filename (.txt)

Data Format No.: n

Header File Name: filename (.txt)

Next Instruction No.: n

Next Instruction Description: Tighten Bolt m

Status Display

<instruction no.>: <instruction> <bolt no.> e.g. 23: Tighten #7

Figure 6:
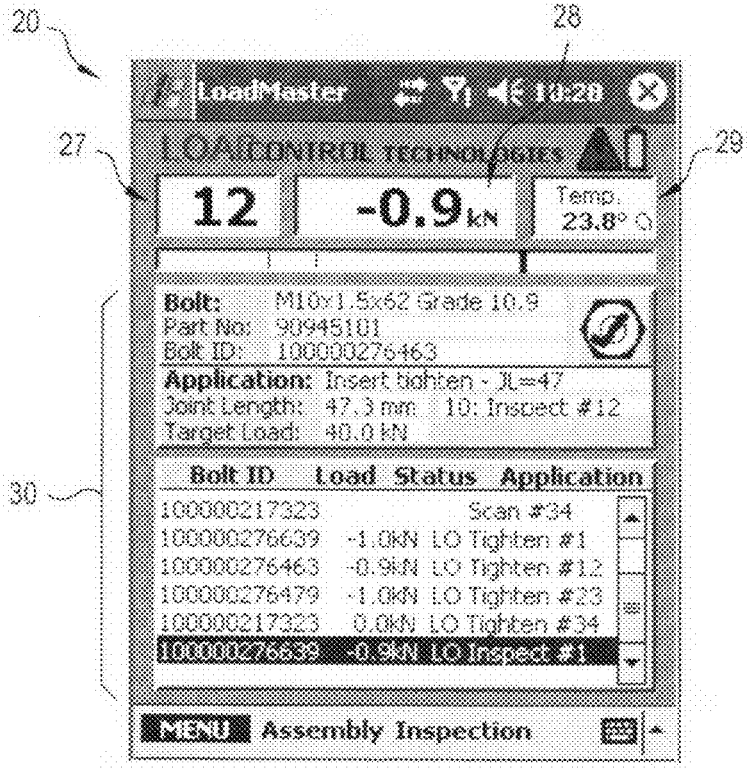

Touching status display pulls up PIP instruction selection menu if authorized, please see FIGS. 5 and 6 of the drawings.

What is claimed is:

1. An apparatus for assembling a joint including plural fasteners comprising:

an assembly tool;

an electronically controllable unit coupled with the assembly tool; and an electronic control circuit configured to make ultrasonic load measurements coupled with the assembly tool and the electronically controllable unit;

wherein the electronic control circuit and the electronically controllable unit operate to dynamically control operation of the assembly tool, and to precisely stop the assembly tool at a specified stopping load; and wherein the electronic control circuit includes machine implemented and predefined procedures performing a plurality of desired tightening operations on at least one of the fasteners, and wherein each of the desired tightening operations operate in combination with the electronically controllable unit to dynamically control the assembly tool to tighten said one of the fasteners.

2. The apparatus of claim 1 wherein the assembly tool is a pneumatic assembly tool, and wherein the electronically controllable unit is an electronically controlled air pressure regulator.

3. The apparatus of claim 2 wherein the electronic control circuit and the electronically controlled air pressure regulator operate to provide a reduced tightening rate or a load increase per impact for the assembly tool.

4. The apparatus of claim 1 wherein each of the plural fasteners is simultaneously coupled with the electronic control circuit.

5. The apparatus of claim 4 wherein a multiplexer simultaneously couples each of the plural fasteners with the electronic control circuit.

6. The apparatus of claim 1 which further includes a backup wrench assembly coupled with the plural fasteners, wherein the backup wrench assembly includes a retaining bracket for engaging portions of the joint.

7. The apparatus of claim 1 which further includes an identifying element coupled with the joint, for identifying the joint or features associated with the joint.

8. A method for assembling a joint including a plurality of fasteners using an assembly tool coupled with an electronically controllable unit, and an electronic control circuit configured to make ultrasonic load measurements coupled with the assembly tool and the electronically controllable unit, the method comprising the steps of:

operating the electronic control circuit and the electronically controllable unit to dynamically control operation of the assembly tool, and to precisely stop the assembly tool at a specified stopping load and following predefined instructions stored in memory associated with the electronic control circuit, for performing a plurality of desired tightening operations on at least one of the fasteners responsive to prompts supplied by the electronic control circuit, wherein each of the desired tightening operations operate in combination with the electronically controllable unit to dynamically control the assembly tool to tighten said one of the fasteners.

9. The method of claim 8 wherein the assembled joint is subject to elastic interaction between the fasteners, rocking, or joint relaxation, and which further includes the step of guiding a user through a predefined assembly operation including a sequence of instructions.

10. The method of claim 8 which further includes the step of simultaneously coupling each of the plural fasteners with the electronic control circuit.

11. The method of claim 8 wherein the assembly tool is a pneumatic assembly tool, and wherein the electronically controllable unit is an electronically controlled air pressure regulator.

12. The method of claim 11 which further includes the step of operating the electronic control circuit and the electronically controlled air pressure regulator to provide a reduced tightening rate or a load increase per impact for the assembly tool.

13. The method of claim 8 which includes the step of inspecting the joint using the electronic control circuit.

14. The method of claim 8 which includes the step of identifying the joint using the electronic control circuit.

15. The method of claim 14 which further includes the steps of coupling an identifying element with the joint, and identifying the joint or features associated with the joint using the identifying element.

16. The method of claim 8 which further includes the step of skipping a predefined instruction associated with a fastener when the fastener is at a target load prior to performing the predefined instruction.

17. The method of claim 8 which further includes the steps of calculating interactions between the fasteners and the joint after a first pass operating on the fasteners and the joint, and recalculating parameters of a second pass operating on the fasteners and the joint subsequent to the first pass responsive to the calculated interactions.

18. The method of claim 17 wherein the calculating of the interactions between the fasteners and the joint after the first pass, and the recalculating of the parameters of the second pass, are responsive to the ultrasonic load measurements.

19. The method of claim 8 which further includes the steps of measuring temperature of the fasteners, and compensating for errors from thermal effects.

20. A backup wrench assembly for combination with a fastener coupled with a joint, to limit rotation of the fastener relative to the joint, wherein the backup wrench assembly includes a wrench body for engaging the fastener, and a retaining bracket coupled with the wrench body for engaging portions of the joint.

21. The backup wrench assembly of claim 20 wherein the retaining bracket is removably coupled with the wrench body.

22. The apparatus of claim 1 wherein the plurality of desired tightening operations is a sequence of different procedures performed on at least one of the fasteners.

23. The apparatus of claim 22 wherein the sequence of procedures is performed on one of the fasteners.

24. The apparatus of claim 22 wherein the sequence of procedures is performed on a plurality of different fasteners.

25. The method of claim 8 which further includes the step of performing the plurality of desired tightening operations as a sequence of different procedures performed on at least one of the fasteners.

26. The method of claim 25 which further includes the step of performing the sequence of procedures on one of the fasteners.

27. The method of claim 25 which further includes the step of performing the sequence of procedures on a plurality of different fasteners.

28. An apparatus for assembling a joint including plural fasteners comprising:

an assembly tool;

an electronically controllable unit coupled with the assembly tool; and an electronic control circuit configured to make ultrasonic load measurements with the assembly tool and the electronically controllable unit;

wherein the electronic control circuit and the electronically controllable unit operate to control operation of the assembly tool, and to precisely stop the assembly tool at a specified stopping load;

wherein the electronic control circuit includes machine implemented and predefined procedures performing a plurality of desired tightening operations on at least one of the fasteners, and wherein each of the desired tightening operations operate in combination with the electronically controllable unit to dynamically control the assembly tool; and wherein the assembly tool is a pneumatic assembly tool, and the electronically controllable unit is an electronically controlled air pressure regulator.

29. The apparatus of claim 28 wherein the electronic control circuit and the electronically controlled air pressure regulator operate to provide a reduced tightening rate or a load increase per impact for the assembly tool.

30. An apparatus for assembling a joint including plural fasteners comprising:

an assembly tool;

an electronically controllable unit coupled with the assembly tool; and an electronic control circuit responsive to ultrasonic load measurements coupled with the assembly tool and the electronically controllable unit;

wherein the electronic control circuit and the electronically controllable unit operate to control operation of the assembly tool, and to precisely stop the assembly tool at a specified stopping load;

wherein the electronic control circuit includes machine implemented and predefined procedures performing a plurality of desired tightening operations on the plural fasteners; and wherein a multiplexer simultaneously couples each of the plural fasteners with the electronic control circuit to switch between the plural fasteners to selectively measure load in at least one of the plural fasteners during tightening or to selectively inspect at least one of the plural fasteners which has been tightened.

* * * * *